United States Patent [19]

Callahan

[11] Patent Number: 4,894,760

[45] Date of Patent: Jan. 16, 1990

[54] ADDITIVE COLOR-MIXING LIGHT FIXTURE EMPLOYING A SINGLE MOVEABLE MULTI-FILTER ARRAY

[76] Inventor: Michael Callahan, 40 W. 94th St., New York, N.Y. 10025

[21] Appl. No.: 250,316

[22] Filed: Sep. 28, 1988

Related U.S. Application Data

[63] Continuation-in-part of Ser. No. 66,790, Jun. 25, 1987, Pat. No. 4,797,795, which is a continuation of Ser. No. 750,873, Jul. 1, 1985, Pat. No. 4,697,227, which is a continuation of Ser. No. 443,127, Nov. 19, 1982, Pat. No. 4,527,198.

[51] Int. Cl.[4] ..... F21V 9/00

[52] U.S. Cl. ..... 362/293; 350/315; 362/277; 362/319

[58] Field of Search ..... 362/16, 18, 268, 277, 362/280, 293, 319, 322; 350/311, 315, 318

[56] References Cited

U.S. PATENT DOCUMENTS 3,912,361 10/1975 Bentley ..... 350/315 X
4,361,863 11/1982 Hagner ..... 362/293 X
4,459,014 7/1984 Thebault ..... 362/293 X
4,600,976 7/1986 Callahan ..... 362/293 X

*Primary Examiner*—Stephen F. Husar
*Attorney, Agent, or Firm*—Kenyon & Kenyon

[57] ABSTRACT

An improved color-mixing light fixture that produces a beam suitable for entertainment lighting and varies the apparent color of the beam produced by additively mixing varying proportions of light having two or more different spectral energy distributions is disclosed. The disclosed fixture employs a single light source and a single light beam that provides at least one plane at which light energy passing through any given point is evenly distributed across the beam where it reaches the subject, and disposes a filter array having at least three filter segments each having a different bandpass characteristic spaced around an effective center in that plane. Rotation of the filter array about its effective center adjusts the relative proportion of the colors produced by the filter segments and displacement of it in that plane relative to the beam adjusts the relative proportions of filtered and unfiltered light.

3 Claims, 20 Drawing Sheets

486
403
420
405
REGISTER
OUT
L
IN
498L
576B
576
562L
562D
311
R
ADD
DEC
498
LOCAL MEMORY
ADD
DATA
575
497
560L
562
560A
R
DECODER
560R
560D
568
561A
T
ENCODER
561T
561E

ADDITIVE COLOR-MIXING LIGHT FIXTURE EMPLOYING A SINGLE MOVEABLE MULTI-FILTER ARRAY

This application relates to entertainment and display lighting, and, more specifically, to an improved design for a light fixture that produces changes in apparent beam color by additively mixing varying proportions of light having two or more different spectral energy distributions.

This application is a continuation-in-part of application Ser. No. 07/66,790, entitled "Improved Control System for Variable Parameter Lighting Fixtures", filed June 25, 1987 now U.S. Pat. No. 4,797,795; which is a continuation of application Ser. No. 750,873, entitled "Control System for Variable Parameter Fixtures" filed July 1, 1985, now U.S. Pat. No. 4,697,227; which is a continuation-in-part of application Ser. No. 443,127, entitled "Improved Followspot Parameter Feedback", filed Nov. 19, 1982, now U.S. Pat. No. 4,527,198.

BACKGROUND OF THE INVENTION

Most entertainment lighting applications require a means to selectively vary the apparent color of the light beam produced by the fixtures employed.

For this purpose, virtually every lighting fixture designed for the application provides some means to support at least a planar filter material in its beam. Beam color may be changed by changing the filter material.

This filter material or "gel" generally consists of a flexible gelatin, cellulose acetate, mylar, or polyester base with a colored pigment disposed through the base or applied to it. Five major lines of flexible filter material are available, providing the lighting designer with a choice of more than 200 distinct colors.

While the cost of the filter material itself is modest, the requirement that a change in beam color requires changing filter material has always had disadvantages in those applications that require the color of the beam illuminating a given subject change during use. Without a method of remotely changing the apparent color of the beam produced by a fixture during a performance, lighting a given area of the stage in five colors generally requires the use of five fixtures, each provided with a different filter material but otherwise identical—at a very substantial increase in both direct and indirect cost in fixtures, cabling, dimming, support, and control equipment, as well as in the manpower required to install, adjust, and service this amount of equipment.

It has long been apparent that if a fixture's color could be changed by remote control during the performance, that the number of fixtures required and as such the direct and indirect costs of the total lighting system could be dramatically reduced. As a result, methods of changing the color of a light source from a remote location found use with candles in the 1770s; with electric lights in the 1880s; and electrically actuated changers similar to those disclosed in U.S. Pat. Nos. 2,129,641 and 2,192,520 were in significant use in American theater by the 1930s.

The ultimate extension of the theory that a fixture with remotely variable beam characteristics could produce a significant reduction in the size of the lighting system required for a production leads us to a fixture, as disclosed in U.S. Pat. No. 3,845,351, whose every beam variable is under the control of an electronic memory system. A practical color changer is essential to its success in most applications.

Methods for varying the color of an entertainment lighting fixture's beam in the past have been largely restricted to the use of "gel changers"; mechanisms providing one filter of appropriate size for each beam color desired, and that mechanically displace these filters in and out of the beam to change color as required. Various designs for such "filter changers" have been disclosed, but in operation they may be divided into two classes which may be described as "serial" and "parallel".

In "serial" changers, the filters are attached to a common mechanical support that is displaced relative to the beam in order to insert the desired filter. One of the class is the color wheel as disclosed in U.S. Pat. Nos. 1,820,899 and 2,214,728; a disc supporting a number of filters spaced at a common radii around the hub, the disc rotated to change color. Recently, "roller" changers similar in principle to the unit disclosed in U.S. Pat. No. 3,099,397, which scroll gel strips (produced by fastening squares of flexible filter material to each other) between two reels have come into significant use. Both types of "serial" changers share inherent disadvantages; the number of colors produceable is limited to the number of filter positions as no subtractive combination of two filters is possible. Changing between filters/colors also frequently requires passing through other, unwanted filters/colors occupying intermediate positions on the strip or wheel.

In "parallel" changers, the second major class, each filter is provided with a separately actuated support which displaces it in and out of the beam. The most common type is the "semaphore" changer as disclosed in U.S. Pat. Nos. 2,129,641 and 2,192,520. Such changers allow subtractive combinations of more than one filter/color; "white" light without sacrificing a filter position; and changing between any two filters without passing through others (although semaphore changers are not without their own undesirable intermediate effects during slow color-to-color changes.)

Some hybrids of the "serial" and "parallel" approaches have also been used including parallel changers with two colors per filter support and fixtures with two or more coaxially mounted color wheels or scrollers, but such hybrids cannot mitigate the disadvantages of a type without also mitigating its advantages.

Both "serial" and "parallel" changers have had several important disadvantages:

One is the undesirable intermediate colors such changers can produce during color-to-color transitions. As a consequence, such so-called "color changers" cannot be used to truly change the color of the fixture beam during use. Either the undesirable intermediate colors will be seen—which is unacceptable by modern professional standards. Or the luminaire will have to be turned off during the transition—which is generally impractical. Or two luminaires with two color changers must be provided so that alternating color changers may "preset" to the desired filter and the transition be accomplished by dimming between the two fixtures—the added cost and complexity of the arrangement mitigating most if not all of the benefits of color changer use.

Another disadvantage of such filter changing systems is that the number of colors produceable is limited to the number of filters provided plus the number of subtractive combinations of multiple filters allowed by the mechanical design of the changer itself.

Therefore it has long been desirable to produce a simple and economical system that allows the synthesis of substantially any desired color using a limited number of color filters and that allows color-to-color transitions without undesirable intermediate effects.

Color theory states that either additive or subtractive primaries can be used to synthesize sensations equivalent to those produced by discrete filters.

At least one model of remotely-adjustable lighting fixture has employed a three-color subtractive color changer generally equivalent to that disclosed in U.S. Pat. No. 3,883,243. Such changers provide filters for each of the subtractive primaries, each such filter mechanically displaced relative to the beam to vary the proportion of energy in the beam in the bandpass region of that filter. Such subtractive techniques have apparent limitations in producing saturated color sensations.

The additive primary system has long been used in many fields to produce a range of color sensations, in the theater, notably for borderlights and cyclorama lighting.

Applied to the design of a fixture, one approach has been to provide a single fixture with three light sources, each separately filtered and controlled in intensity, the output of all three sources preferably combined prior to any beam forming elements in the fixture's optical path; an approach disclosed in U.S. Pat. No. 4,071,809. The disadvantage of this approach is the requirement for three light sources with their associated direct costs and power requirements to produce the same beam intensity as a conventional fixture with a single source.

A more power efficient approach is to derive all three additive primaries from a single light source by passing the beam through a series of filters, dividing it into three beams; mechanically douse each one; and then recombine them prior to the beam forming elements in the fixture's optical system, an approach disclosed in U.S. Pat. No. 3,818,216. The disadvantages of this approach include the requirement for mechanical dowsing (electronic dimming of the light source being impractical) and the size, complexity, cost, and light losses of the optical system required.

It has therefore long been desirable to produce a three-color additive mixing fixture suitable for entertainment lighting use that requires only a single source and a single optical path. A color mixing light bulb theoretically suitable for this purpose is disclosed in U.S. Pat. No. 3,225,243, but leaving aside the cost of producing such a bulb and its socket, the difficulty of imaging all nine filaments in a collector of reasonable size will be apparent.

It is the object of the present invention to provide an improved additive color mixing fixture of greater simplicity and efficiency, practical for use with existing light sources and fixture designs.

SUMMARY OF THE INVENTION

The improved color mixing fixture of the present invention achieves these and additional objects in an apparatus of unusual simplicity.

The improved color mixing fixture of the present invention disposes a filter array adapted for rotation about an effective center, and having at least three filter segments preferably corresponding to three additive primaries spaced about that effective center, in the optical path of the light fixture, such that the light beam can pass through a single such filter segment, and that which filter segment the beam passes through can be varied by rotation of the filter array about its effective center in the known manner.

The disclosed fixture, however, provides at least one hyperfocal region and locates the filter array in that region, such that rays of light passing through any area of the beam where it intersects the filter array are uniformly distributed throughout the beam as a whole, at least where the beam reaches the desired subject.

The fixture is also adapted to permit the relative displacement of beam and filter array, such that the relative proportions of the beam passing through the filter array and bypassing the filter array entirely may be adjusted.

The combination of filter array rotation and beam/filter displacement permit the adjustment of the relative proportions of the three additive primaries as well as their dilution with variable quantities of unfiltered "white" light, to produce a wide range of color sensations using a single light source, a single optical path, a single planar filter array, and a single moving filter element.

Various improvements to such a color mixing fixture are also disclosed, including the benefits of the use of more than three filter segments for the array.

DETAILED DESCRIPTION OF THE INVENTION

Figure 1:
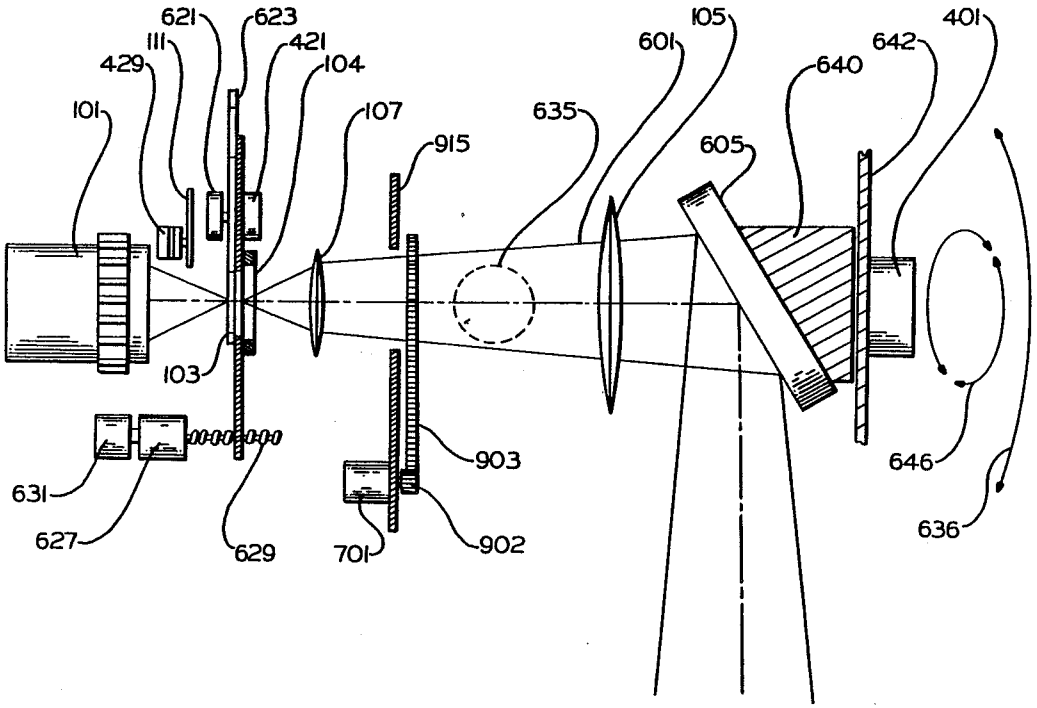
FIG. 1 is a section of one embodiment of the improved color mixing fixture of the present invention, equal to FIG. 1 of prior related application Ser. No. 750,873.
Figure 2:
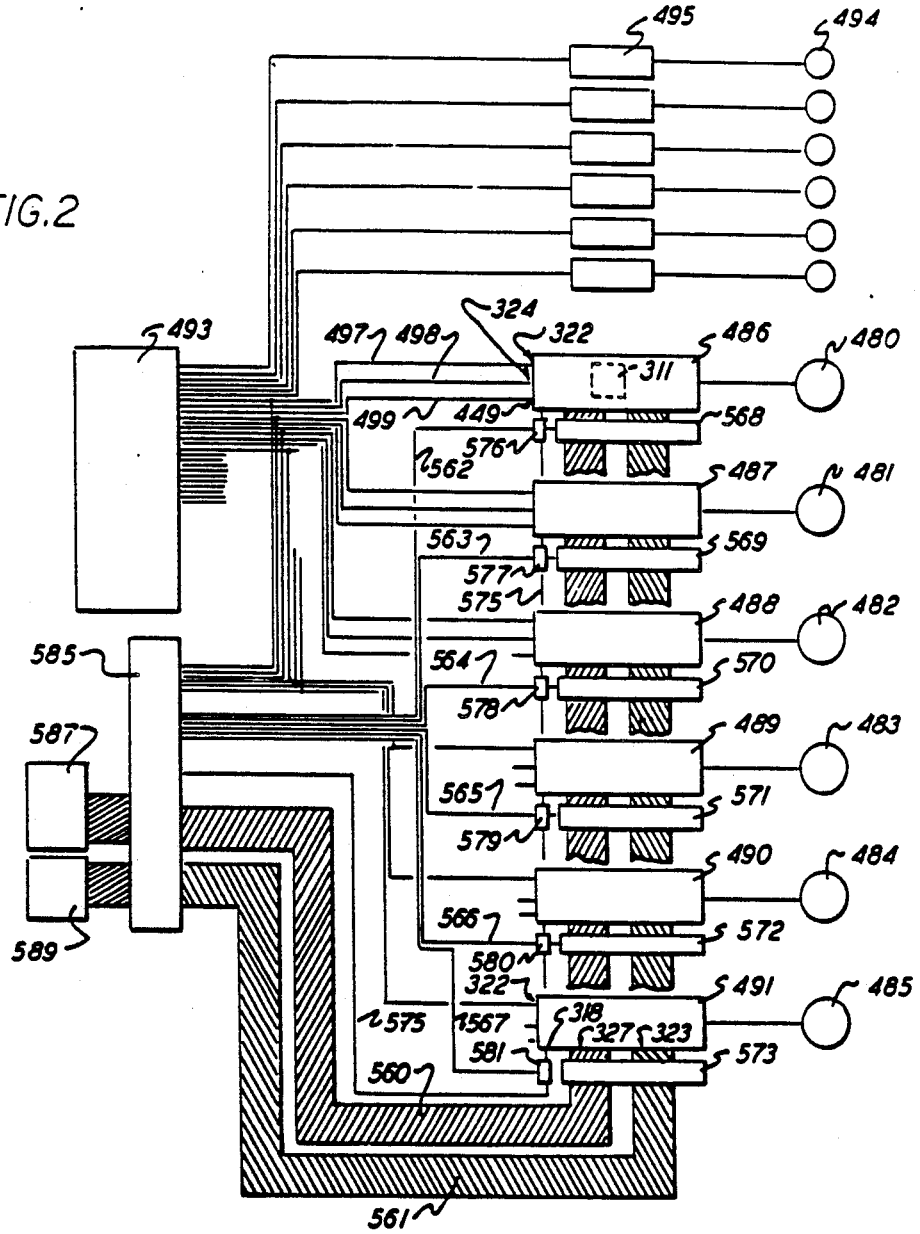
FIG. 2 is a block diagram of a control system which may be employed for the control of the disclosed color mixing fixture, equal to FIG. 2 of the same application.

Refer now to FIG. 1, reproduced from the grandparent application Ser. No. 750,873, now U.S. Pat. No. 4,697,227, which, with prior related application Ser. No. 443,127, now U.S. Pat. No. 4,527,198 and with U.S. Pat No. 4,527,198, are included in their entirety by reference.

FIG. 1 represents a section through one embodiment of the color mixing fixture of the present invention.

A light source and its associated light collecting reflector 101 are combined with a fixed focal length optical system comprising lenses 107 and 105 imaging a circular aperture 103. Other types of optical elements and/or system may also be employed.

Various beam modifying elements including an iris 104 and a motorized gobo wheel 623 are located at the aperture. Ultimately, a solid state filter having a matrix of individually-addressable variable attenuation, diffusion, or reflection elements (employing, for example, liquid crystal or light valve technology) may be used to vary both beam size and shape.

Beam intensity may be remotely adjusted by means of mechanical dowser 111 and its associated beam intensity actuator 429, although an electronic dimmer as disclosed in U.S. Pat. No. 3,397,344 may also be employed.

Beam intensity may also be varied by means of a solid state variable-diffusion filter such as the Mirrus TM filter (as distributed by Artiflex, Newport Beach, Calif). While such filters do not directly vary beam intensity, they have been located at the beam exit point to diffuse the beam, with the byproduct of reducing beam candlepower and the undesirable effect of increasing beam size and therefore coverage. By contrast, locating such a filter prior to the imaged aperture (in the present example, in the same plane as mechanical dowser 111), this undesirable effect can be reduced or eliminated. A second such filter located forward of the aperture; the displacement of an optical element; or the displacement of the aperture assembly along the optical axis with actuator 627 may be employed to vary beam edge sharpness.

Beam azimuth and elevation may be adjusted by two-axis displacement of the fixture, as disclosed in U.S. Pat. Nos. 1,680,685 and 1,747,279, or of a beam-directing mirror as disclosed in U.S. Pat. No. 2,054,224 or any other known means. In the illustrated embodiment, beam angle is adjusted by reflection from mirror 605 which is mounted by bracket 640 to motor 401 which, in turn, is mounted to the forward end of fixture chassis 642. This allows the rotation 646 of the beam in a first plane perpendicular to the optical centerline. The fixture chassis 642, in turn, is supported at its center of gravity by a yoke and pivot driven by motor 635 which allows the rotation 636 of the fixture in a second plane parallel to the optical centerline but always perpendicular to the first plane of rotation for the beam.

The filter array 903 of the illustrated embodiment is mounted to support plate 915 which is located in the hyperfocal region of the optical system, that is, the location in the optical path at which the rays passing through a given point in a plane intersecting the beam are uniformly distributed across the beam where it illuminates the subject.

Figure 5A:
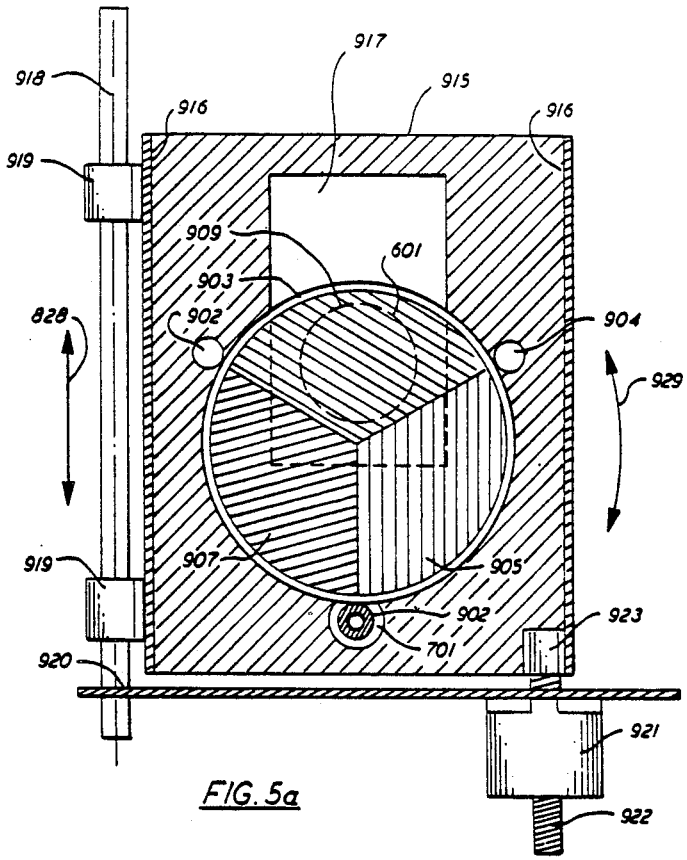
FIG. 5A is a detailed view of one embodiment of the filter array of the improved color mixing fixture of the present invention, equal to FIG. 5A of the prior application.
Figure 5B:
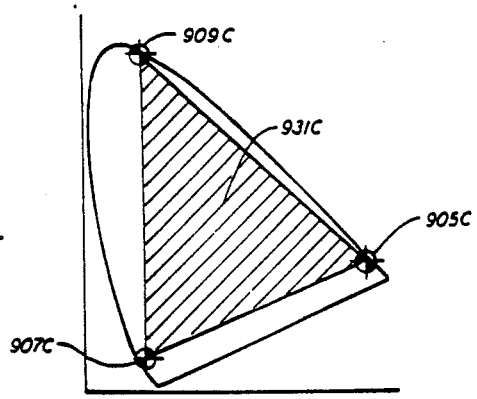
FIG. 5B is a CIE chromaticity diagram illustrating the coordinates of the filters employed in and possible color sensations produced by the filter array of FIG. 5A, equal to FIG. 5B of the prior application.

Refer now to FIG. 5A, reproduced from the grandparent application Ser. No. 750,873. Three segments of interference-type filter material (as produced by Optical Coating Laboratory, Inc, Santa Rosa, Calif. 95407) form segments of a filter array. Segment 909 is a saturated green, segment 905 a saturated red, and segment 907 a saturated blue whose coordinates on the CIE chromaticity diagram FIG. 5A are indicated by the same number with the suffix "C". The filter array is surrounded by a structural rim 903, which rides between roller bearings 904 and a drive roller 902 attached to the shaft of a motor 901 to allow rotation of the array about its center. The array has been mounted such that beam 601 passes through it at the half-radius point in a manner that may fall within the limits of only one filter segment.

With the array in the position shown, all of the light in beam 601 where it intersects the filter array at 706 will pass through filter segment 909, and as such the beam exiting the fixture will be primary green. Clearly, by rotating the array 120°, filter segment 905 can be brought into the beam resulting in primary red, and a similar further rotation to filter segment 907 will produce a beam of primary blue. The operation of the array is thus identical to that of a prior art color wheel; the number of colors produced being equal to the number of filter segments.

Figure 6A:
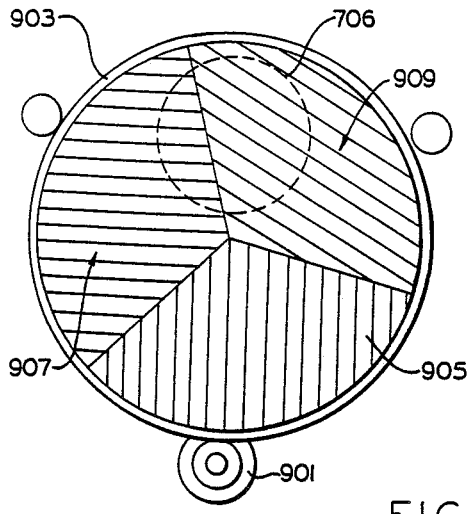
FIG. 6A illustrates the three segment filter array of FIG. 5A rotated such that the beam passes through two adjacent segments in unequal proportions.
Figure 6B:
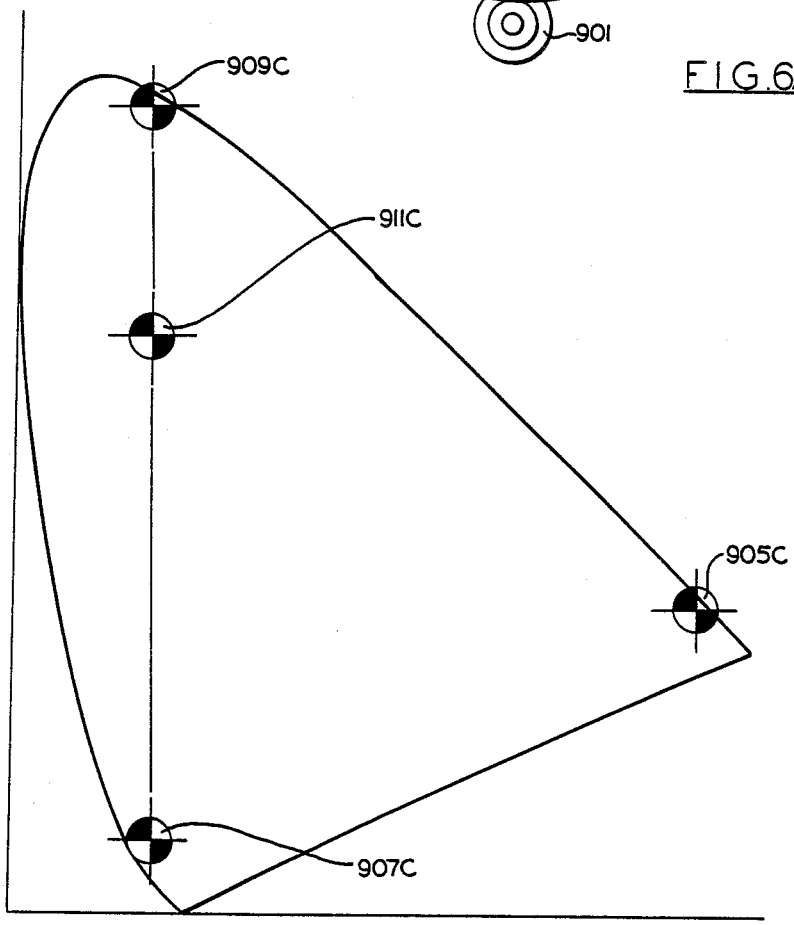
FIG. 6B is a CIE chromaticity diagram illustrating the coordinates of the filters employed in and color sensation produced by the filter array position of FIG. 6A.

Refer now to FIGS. 6A and 6B. The mechanical assembly of FIG. 5A has been omitted for clarity. The array has been rotated only partly such that the beam 706 passes through two filter segments 907 and 909. One-third of the area of the beam passes through segment 907 and two-thirds through segment 909. As a result, one-third of the light output of the fixture consists of primary blue light (coordinates 907C), and two-thirds primary green (coordinates 909C). Because the filter array is located at the hyperfocal point, an equal proportion of light of each color is distributed to all points in the beam as it reaches the subject and, as a result, the actual color sensation produced by the mixture is that of a green of higher blue content (coordinates 911C) than the green of filter 909.

Figure 7A:
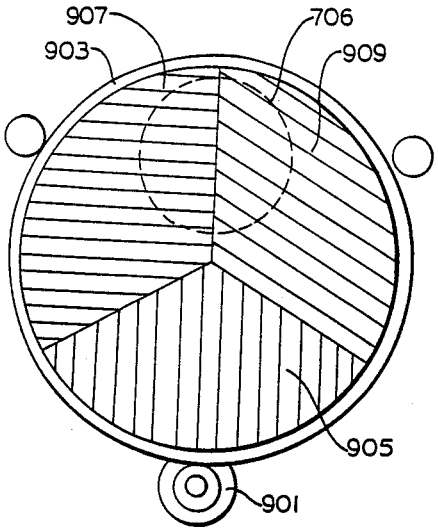
FIG. 7A illustrates the three segment filter array of FIG. 5A rotated such that the beam passes through two adjacent segments in equal proportions
Figure 7B:
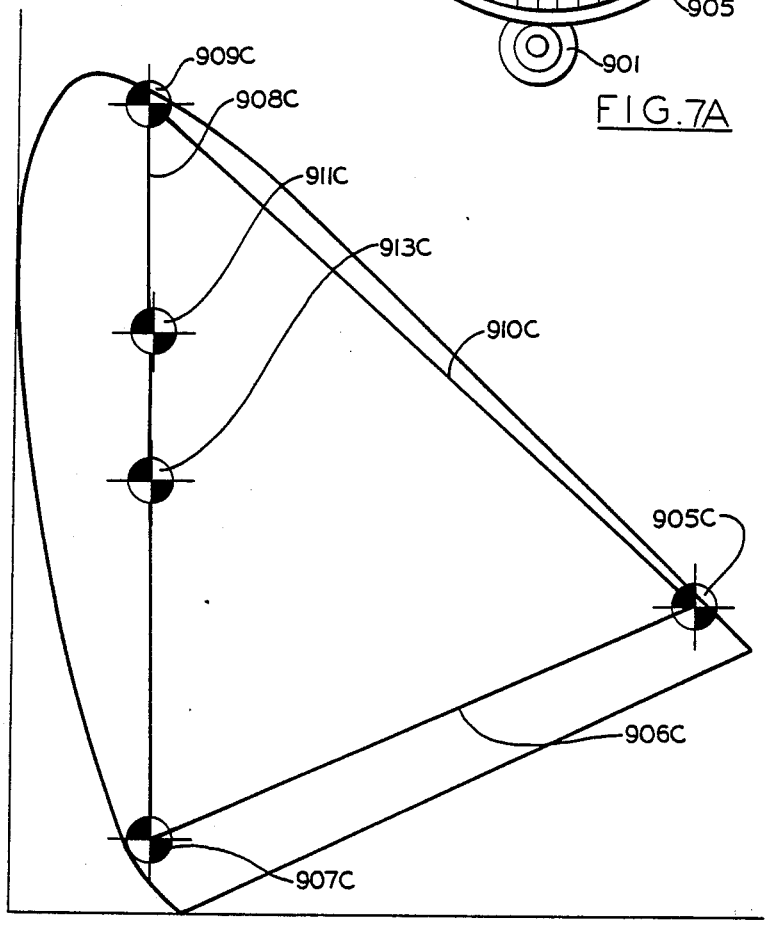
FIG. 7B is a CIE chromaticity diagram illustrating the coordinates of the filters employed in and color sensations produced by the filter array position of FIG. 7A and other filter array positions.

Refer now to FIGS. 7A and 7B. The filter array has been rotated such that an equal portion of the beam passes through both filter segments. As a result, half of the light output of the fixture consists of primary blue and half of primary green, resulting in a color sensation produced by the mixture of cyan (coordinates 913C).

It will thus be apparent that rotation of the array to adjust the relative proportion of filter segments 909 and 907 in the beam, by adjusting the relative proportion of their respective primaries in the beam, will produce the same color sensation as any pure color on the line 908C. Similarly, filter segments 905 and 907 can, in combination, produce the same sensation as colors on the line 906C and filter segments 905 and 909 produce the color sensations along line 910C. However, only the colors on lines 906C, 908C, and 910C may be produced; none of the lighter tints enclosed within the triangle formed are practical.

Producing such tints requires the ability to adjust the relative proportion of the three primaries independently. In prior art additive color mixing fixtures, this has been accomplished by providing separate light sources for each primary, or by dividing the output of one light source into three beams, separately filtered and attenuated and then recombined.

By contrast, the color mixing fixture of the present invention achieves three color additive mixing with a single light source, a single beam, and a single filter assembly with one moving element.

Refer again to FIG. 5A where the elements necessary to achieve this object are illustrated.

The filter array having three segments with coordinates 905C, 907C, and 909C supported by rim 903 and rotated by motor 701 via rollers 902 and 904 is mounted to support plate 915. Support plate 915 may be displaced along an axis in a plane perpendicular to the optical centerline of beam 601 on linear bearings 919 riding on rail 918 by motor 921 driving lead screw 922. Opening 917 in plate 915 allows passage of the beam.

Figure 8A:
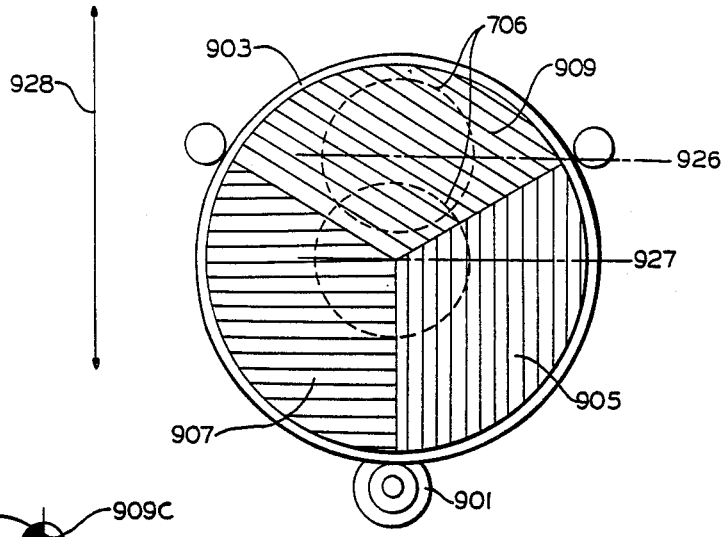
FIG. 8A illustrates the displacement of the three segment filter array of FIG. 5A such that the beam passes through all three filter segments in equal proportion.
Figure 8B:
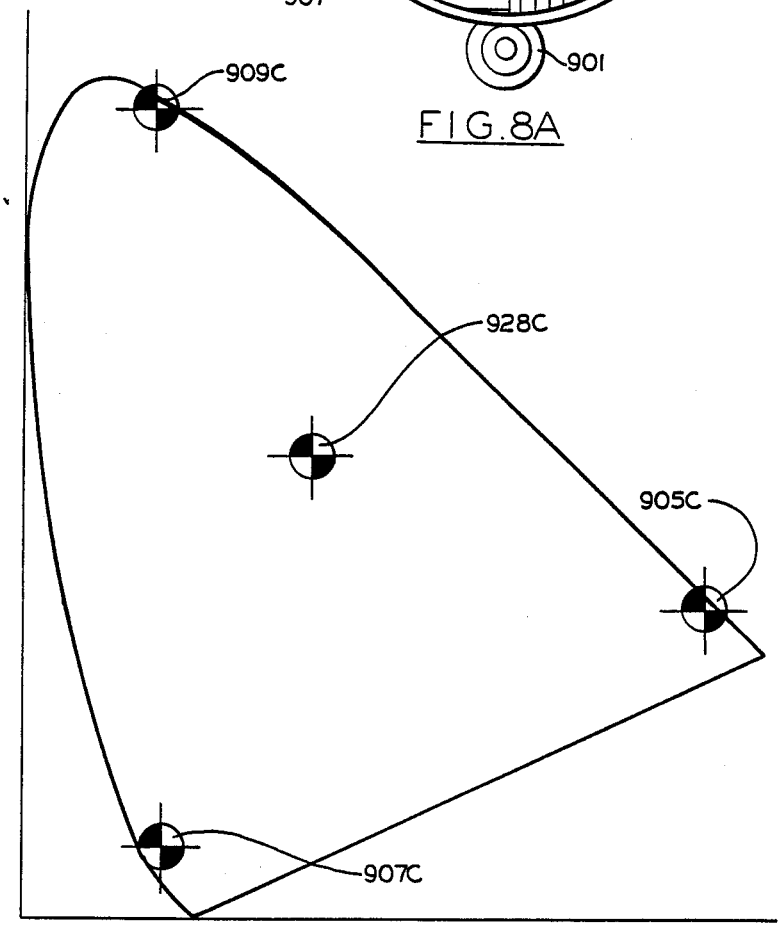
FIG. 8B is a CIE chromaticity diagram illustrating the coordinates of the filters employed in and color sensation produced by the filter array position of FIG. 8A.

Refer now to FIGS. 8A and 8B. The mechanical assembly of FIG. 5A has been omitted for clarity.

Through the operation of motor 921, the filter array has been displaced along axis 928 from the positions of FIG. 6A and FIG. 7A to a new position 927 in which the beam passes through the center of the array. As a result, one-third of the beam is filtered by segment 905, one-third by segment 907, and one-third by segment 909 resulting in a similar proportion of the three primaries in the beam reaching the subject. The subject is thus illuminated in an equal additive combination of the three primaries and a color sensation equivalent to the tint at coordinates 928C results.

Figure 9A:
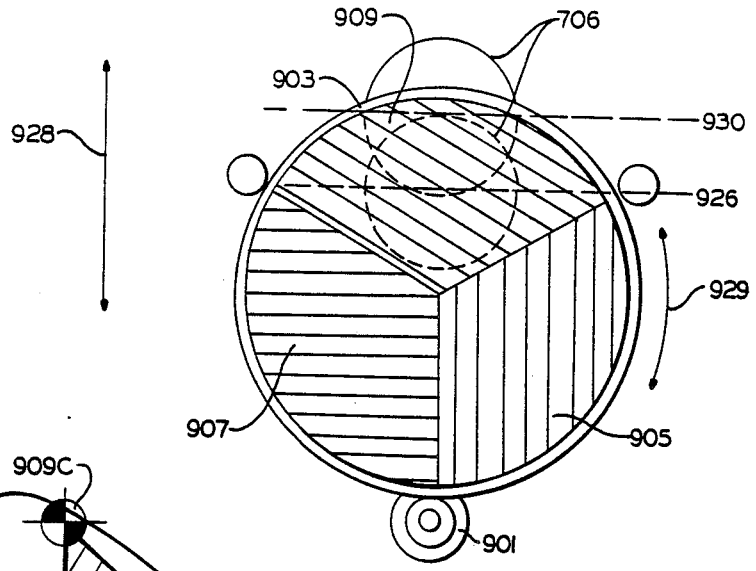
FIG. 9A illustrates the axes of rotation and displacement employed by the embodiment illustrated in FIG. 5A.
Figure 9B:
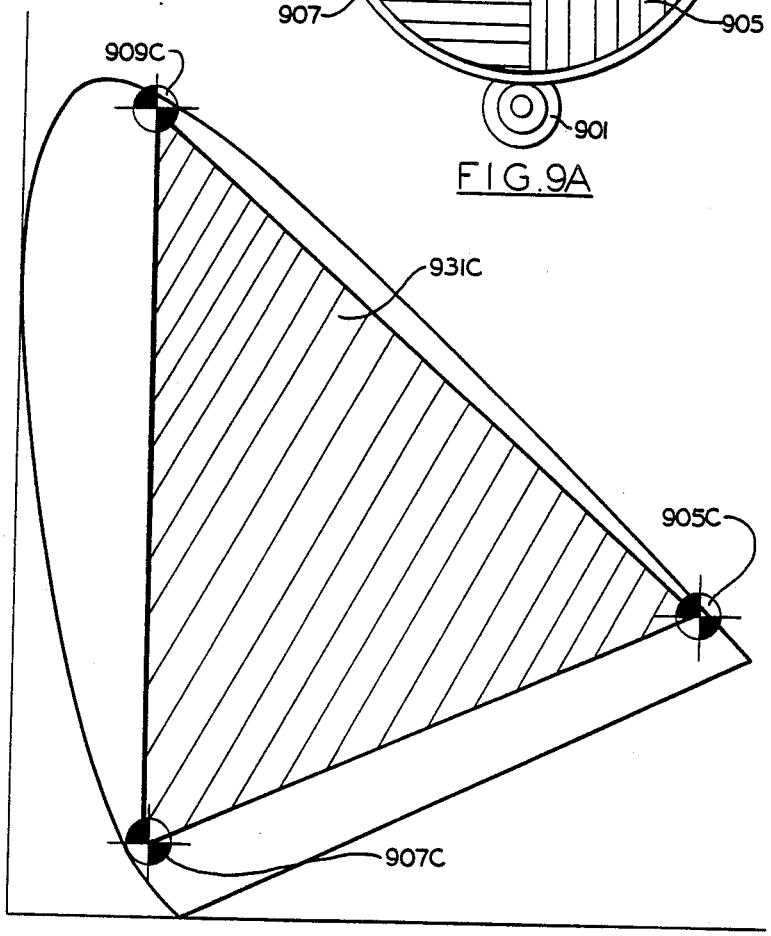
FIG. 9B is a CIE chromaticity diagram illustrating the range of possible color sensations produced by the combination of filter assembly rotation and displacement illustrated in FIG. 9A.

Refering to FIGS. 9A and 9B it will be seen that the ability to both rotate the filter array about its effective center and to displace that center relative to the beam, allows the relative proportions of all three primaries in the beam to be adjusted, and as such, a unit of extreme simplicity to produce the same color sensation as any conventional filter material within the area 931C.

While the displacement of the filter array in the manner illustrated in FIG. 8A permits synthesis of substantially any color sensation within the area 931C, it shares with other additive color mixing fixtures the disadvantage of limited efficiency. While the relative proportions of primaries that pass through the filter array in FIG. 8A are equal, and the resulting color sensation approximates that of the unfiltered beam, the total intensity of the beam is reduced by approximately two-thirds because each filter segment will block all those wavelengths not within its bandpass region. Thus, in contrast to conventional gel filters whose tints pass 60% or more of beam intensity and for which "no color" passes 100%, such an additive mixing fixture is limited to a maximum efficiency of approximately 30–40%, less the losses of the filters within their bandpass regions. Further, the more saturated the filters used—and therefore efficient—the system at producing saturated color sensations, the less efficient it is in producing less saturated color sensations.

Refer now to FIG. 9A where an improved filter array without this disadvantage is illustrated. By the expedient of permitting the displacement of the filter array along axis 828 such that all or any part of beam 706 may bypass the filter assembly, "no color" beams may be produced by displacing the array out of the beam—achieving 100% efficiency. Tints may be produced by combining one or more primaries with "white" light by positioning the array with the beam at location 706B, such that tints are produced by a combination of pure color and white light for a far higher efficiency than would be achieved by any prior art additive primary system. The array can, of course, produce all the single primary and two primary effects previously described.

Like all three-color additive systems, the embodiment of the filter array of the present invention illustrated in the previous Figures has the disadvantage of the inability to produce color sensations outside of the area 931C defined by the triangle formed by the three primaries.

Figure 10A:
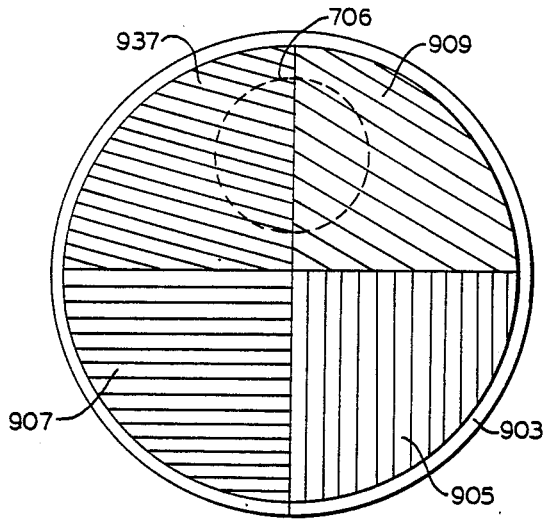
FIG. 10A illustrates a filter assembly having four filter elements.
Figure 10B:
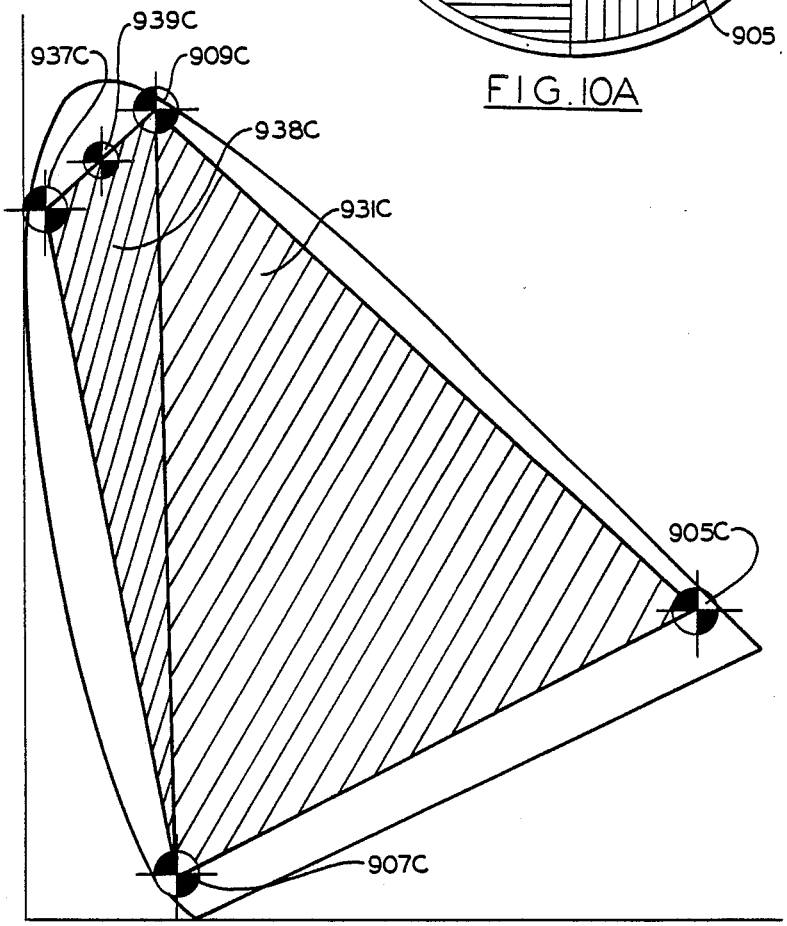
FIG. 10B is a CIE chromaticity diagram illustrating the improvement in the range of color sensations that may be produced by the color mixing fixture of the present invention with the addition of a fourth filter segment.

By contrast with prior such additive systems, it will be apparent that additional filter segments may readily be added to the array. Refer now to FIG. 10A where such an array is illustrated. A fourth filter segment 937 (at coordinates 937C) has been added. With the array in the position shown, equal portions of the beam pass through segments 909 and 937 producing a color sensation equivalent to the pure color at coordinates 939C, which could not be achieved by the system of the previous Figures. Rotation about its effective axis permits the filter array to produce those color sensations along the sides of the polygon linking the chromaticity coordinates of the four filter segments. Displacement relative to the beam permits the dillution of any such color sensation with "white" light to produce the tints falling between it and the coordinates of the unfiltered light source. Thus, the simple expedient of adding filter segment 937 increases the color sensations produceable to include those within area 938C at minimal cost. It will be apparent that any number of additional filter segments may also be added.

It will also be apparent that filters may be chosen having maximum efficacy for the receptor. For example, when fixtures with the disclosed color mixing apparatus are employed for lighting television productions, filter segments may be used whose spectral properties match those of the additive primary filters employed in the television camera itself. Similarly, a filter array may employ filters for the so-called "tri-stimulus" primaries to which the cones of the human eye are believed most sensitive, and which, in the case of flourescent tubes with phosphors producing light at only these three wavelengths, have been found to produce the same sensation as full spectrum white light—with better color fidelity and perceived sharpness.

It is a further advantage of the system of the present invention that a variety of transitions from color sensation to color sensation are readily produceable.

Figure 9C:
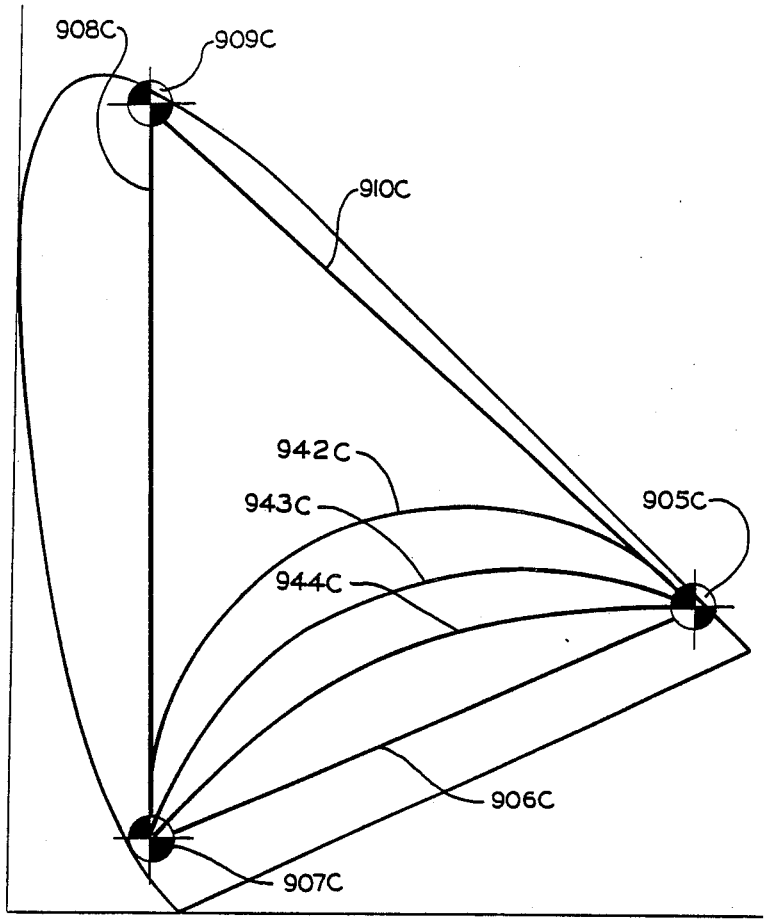
FIG. 9C is a CIE chromaticity diagram illustrating the range of possible transitions between color sensations that may be produced by different combinations of filter assembly rotation and displacement.

Refer now to FIG. 9C. A three segment array will be used to change beam color from primary red (905C) to primary blue (907C). Depending on the direction of rotation, the beam color will pass through magenta, purple, lavender, and violet (route 906C) or orange, yellow, green, and cyan (via 910C and 908C). Further, by displacing the array along its other axis, the transition between red and blue may take place through tints of any desired saturation (942C, 943C, or 944C) depending on the degree of displacement.

The advantages of the color mixing fixture of the present invention are a product of its basic operating principles, and variations in the design of embodiments should not be understood as limited except by the claims.

It will be apparent that the filter array may be designed such that it is supported and rotated by a central hub driven directly by an actuator in the well-known manner.

It will be apparent that the beam can also be displaced relative to the filter array to produce an equivalent result. For example, a mirror or prism could be located prior to the array, reflecting the beam 601 at a right angle and parallel to the plane of the filter array. A second mirror could then redirect the beam parallel to its original axis; a third mirror redirect it parallel to its path between the first and second mirror and in the opposite direction; and a fourth return it to its original axis. By coupling the second and third mirrors to an actuator so as to permit their displacement (and that of the portion of the beam between them) relative to the original axis, and by locating the filter array in the U-shaped detour in the optical path formed by the mirrors, that portion of the beam intersecting the filter array 706 can be "moved" relative to a fixed filter array. Such an arrangement may have value if it can also be used to produce the appearance of rotating a gobo in the gate.

It will be apparent that the filter array can be produced by selectively depositing the appropriate materials on separate areas of a common substrate or, perhaps more economically, by mechanically assembling separate precut filters of the required transmission characteristics to form a larger array.

While the boundaries between filters and along the perimeter of the filter array are illustrated as sharply delineated, it will be understood that various techniques may be employed to "blur" these boundaries, where it may be desirable to improve the efficacy of color mixing.

One such technique is the trimming of filter edges in a "zig-zag" or similar pattern that has the effect of progressively increasing the proportion of filter area. This technique can be used along the perimeter of the filter array and/or between filters to smooth transitions.

Alternatively, using well-known fabrication techniques, filter materials can be selectively deposited on a common substrate in patterns that serve the same function.

Filter segments of intermediate colors can also be produced by alternating bands of two other colors.

The current orientation of the filter array can be determined by any known means, including but not limited to the use of an encoder or other feedback sensor coupled to the array or its actuator and/or an equivalent feedforward scheme involving one or more indexing marks and the counting of pulses incrementing the motor.

Similarly, a means sensing the apparent beam color directly (such as known systems for determining the spectral energy distribution and/or chromaticity coordinates of a light source or display) can also be employed.

Differences between the transmissive and/or reflective properties of the filter segments of the filter array can also be used in determining filter array position.

For example, by employing optical sensors with LEDs in the green and red wavelengths on one side of the filter array of FIG. 5A, and aligned photodetectors on the other, the location of the boundaries between any two filter segments can be determined, insofar as the red LED will be sensed through the red filter segment 905; the green LED through the green filter segment 909; and neither LED sensed through blue filter 907. By correlating the rotation of the actuator 701 with the state changes of the two LEDs, the current orientation of the filter array can be determined with great accuracy.

Other wavelength-selective methods of sensing filter presense can, of course, be employed.

Similarly, a clear area in the filter area (whether produced by the trimming of the filter segments themselves; by selective deposition of the filter coating; or by scratching off the coating) can be used to provide one or more indexing marks, identified either by the increase in the total amount of light passed or by the range of wavelengths passed by such clear areas when contrasted to the amount of light and/or the wavelengths passed by the filter coating.

Selective deposition or post-processing can also be used to convert the filter array into an optical encoder element by, for example, producing coded bands that permit the filter array to also serve as the disc of an incremental or absolute optical encoder.

Where, for example, the array is provided with a structural rim, that rim can also be used as an encoder element (for example, by sensing teeth).

Further, such techniques can be used to locate the position of not just filter arrays but dowser and shutter blades and gobo wheels.

For example, to employ an automated version of the "shutters" found in known "lekos" in the fixture of FIG. 1 requires a means for determining the position of the shutter blades. While commercially-available encoders or transducers could be coupled to the shutter blades or their actuators, this unnecessarily increases the size, cost, and complexity of the total shutter assembly. Alternatively, the shutter blades can be punched or preferably photo-etched of stainless steel or titanium with openings that permit the shutter blade to form its own encoder element.

A similar technique can also be used to identify filters or gobos.

For example, light projectors that permit the user to remotely insert any selected one of a plurality of gobos or templates into the fixture beam have long been known. This feature has also been incorporated in many automated lighting fixtures. In both cases it is desirable that the user be able to change the gobos in the selection, and most such fixtures have provided this capability. With the ability to change gobos comes the probability that different fixtures may have different gobo selections and/or that the gobos in a given fixture may change over time. It is highly desirable that the user be able to determine which gobo occupies each position in each fixture. Clearly, this requires a significant amount of effort and care.

Most gobos are produced by photo-etching or photodeposition, and as such, no cost penalty is associated with the number or design of openings or clear areas incorporated in the gobo. There is and has been, therefore, no reason why additional openings cannot be provided in the gobo beyond the area imaged by the fixture that represent a binary-coded value identifying the gobo design. By locating these openings along a radius of the gobo wheel rotation, a single detector can scan the coded information on each gobo as the gobo wheel is rotated past it. A single rotation of the gobo wheel would thus be sufficient to determine whether a gobo and which gobo is present in each gobo wheel position. This information can be uploaded from the fixture to the control system via the data transmission means between them, where it can be displayed for the operator as will be described below. The same codes can be used to determine gobo wheel position.

Where multiple filter arrays can be employed in a fixture and/or filter segments in an array, similar techniques can be used to determine the filter array and/or segments in use.

Where the fixture light source is mechanically doused rather than dimmed, it can be used as the source of light for such sensing systems, for example, by means of a fiber optic cable carrying light from the lamphouse.

Figure 3:
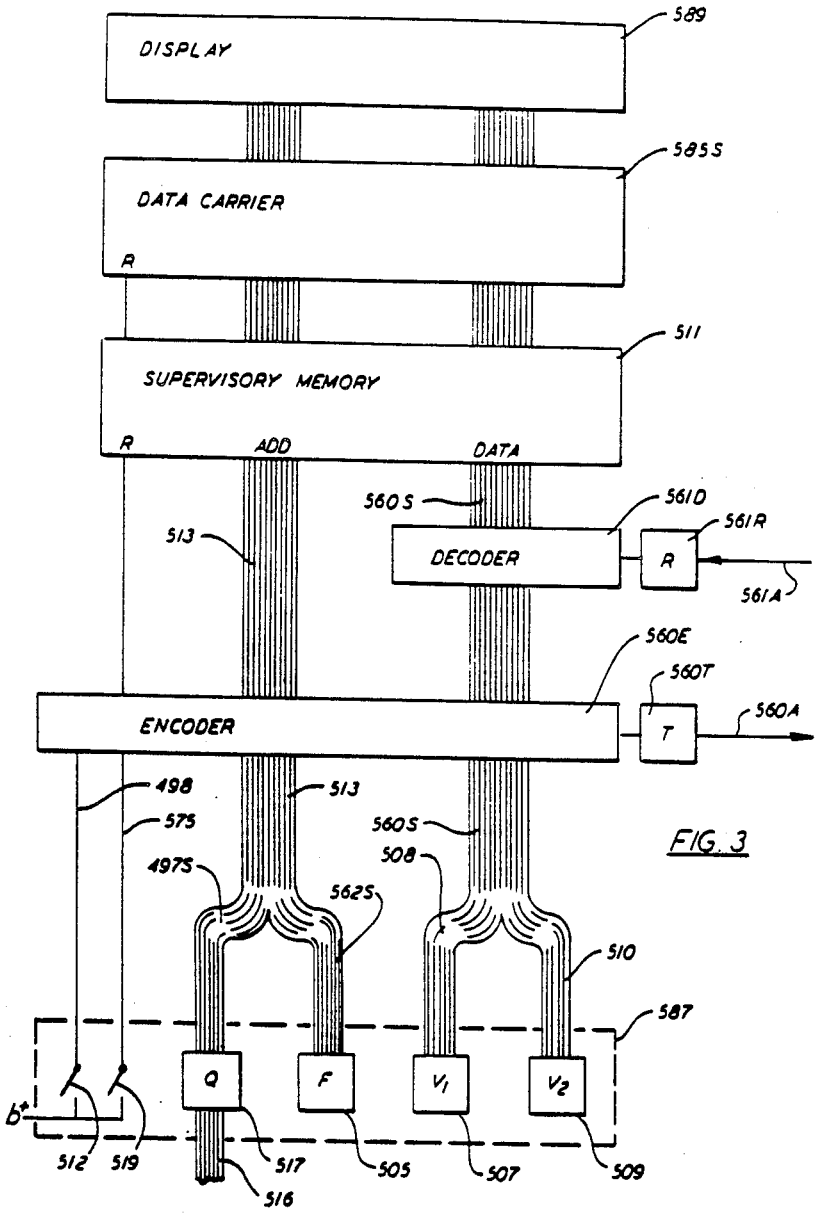
FIG. 3 is a detailed view of one embodiment of a supervisory control unit of FIG. 2, equal to FIG. 3 of the prior application.
Figure 4:
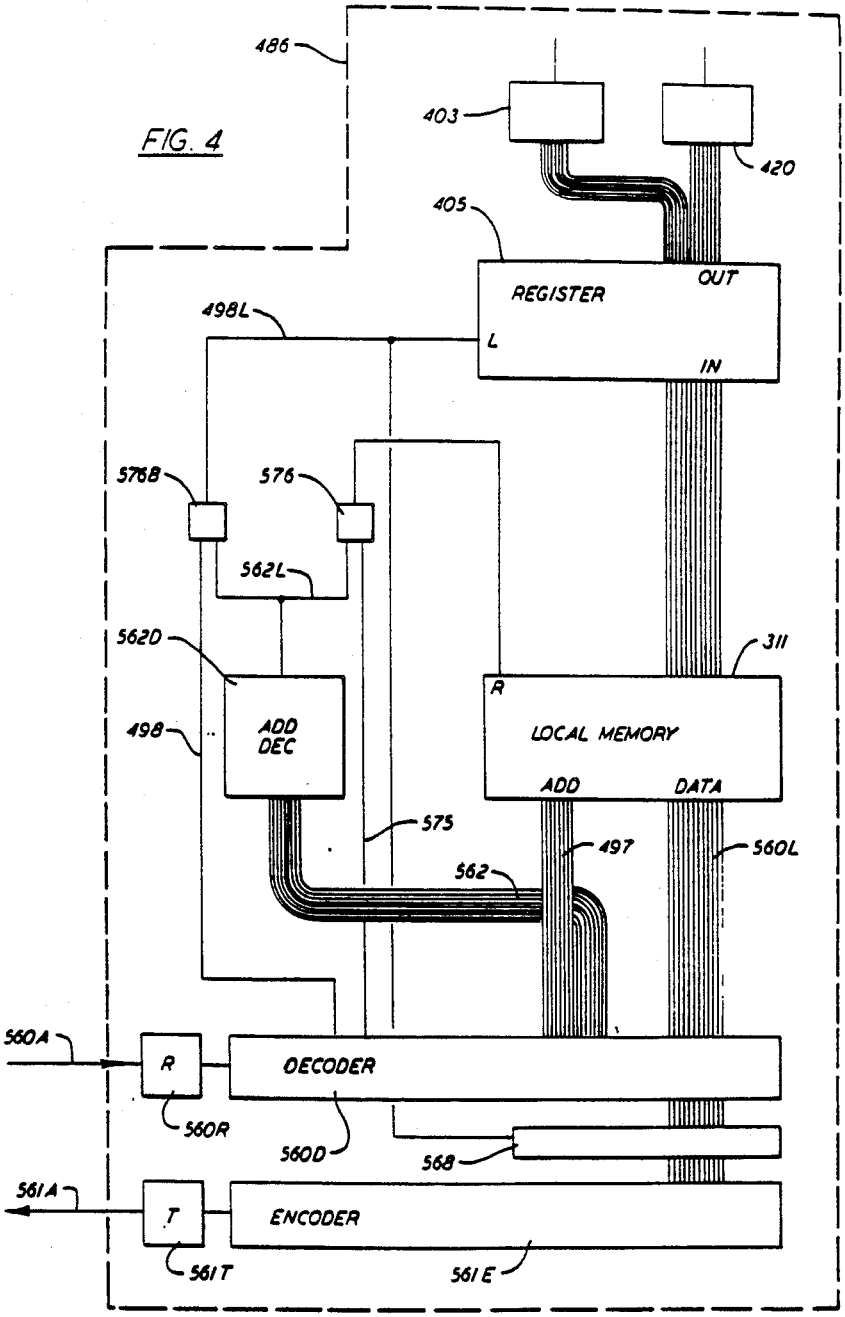
FIG. 4 is a detailed view of one embodiment of a local control system of FIG. 2, equal to FIG. 4 of the prior application.

The improved color mixing fixture of the present invention is coupled to a remote-control system, such as that illustrated and disclosed in the prior related applications, the Figures illustrating which are reproduced here. Actuators 701 and 921 of the color mixing fixture, as illustrated in FIG. 5A, may be coupled to motor drives 403 and 420 of a local control system as illustrated in FIG. 4. The parameter controls 507 and 509 of the supervisory control unit, as illustrated in FIG. 3, thus permit the direct adjustment of the hue and saturation of the light beam. The memory means 311 permits the user to store a desired color sensation for each lighting effect and to reproduce it at a later date.

In the case of a fixture providing not only for adjustment of beam color, but of other parameters such as beam pan, tilt, size, shape, edge-sharpness, and/or intensity; separate or a common memory means 311 may be used for the storage of desired adjustment values. In either case, this memory means 311 may take the form of a RAM or EEPROM memory card or otherwise readily removeable subassembly.

When prior automated lighting fixtures incorporating a local control system fail, requiring the replacement of the fixture with a spare, the removal of the failed fixture also removes all of the cues loaded in that fixture. Transferring those cues to the replacement fixture requires either a "null modem" connection between the failed and replacement fixtures, which is not only inconvenient under field conditions but presupposes that the failed fixture retains enough electronic functionality to participate in the transfer—or requires a download via the connection between the replacement fixture and the supervisory control system of a duplicate set of all of the parameter values for the fixture, which consumes a significant amount of time on the system data link (which is particularly undesirable under performance or rehearsal conditions).

By contrast, the use of a non-volatile data carrier for the local memory means 311 (or as a duplicate memory means with working memory provided in RAM) permits the rapid replacement of a failed fixture and the transfer of all desired parameter values to the replacement fixture by the simply expedient of unplugging the data cartridge from the failed unit and plugging it into the replacement.

While control systems suitable for use with the disclosed color mixing fixture have been the subject of many prior disclosures including the prior related applications, a control system with a more sophisticated operator interface and a variety of other novel features may also be employed.

Figure 11A:
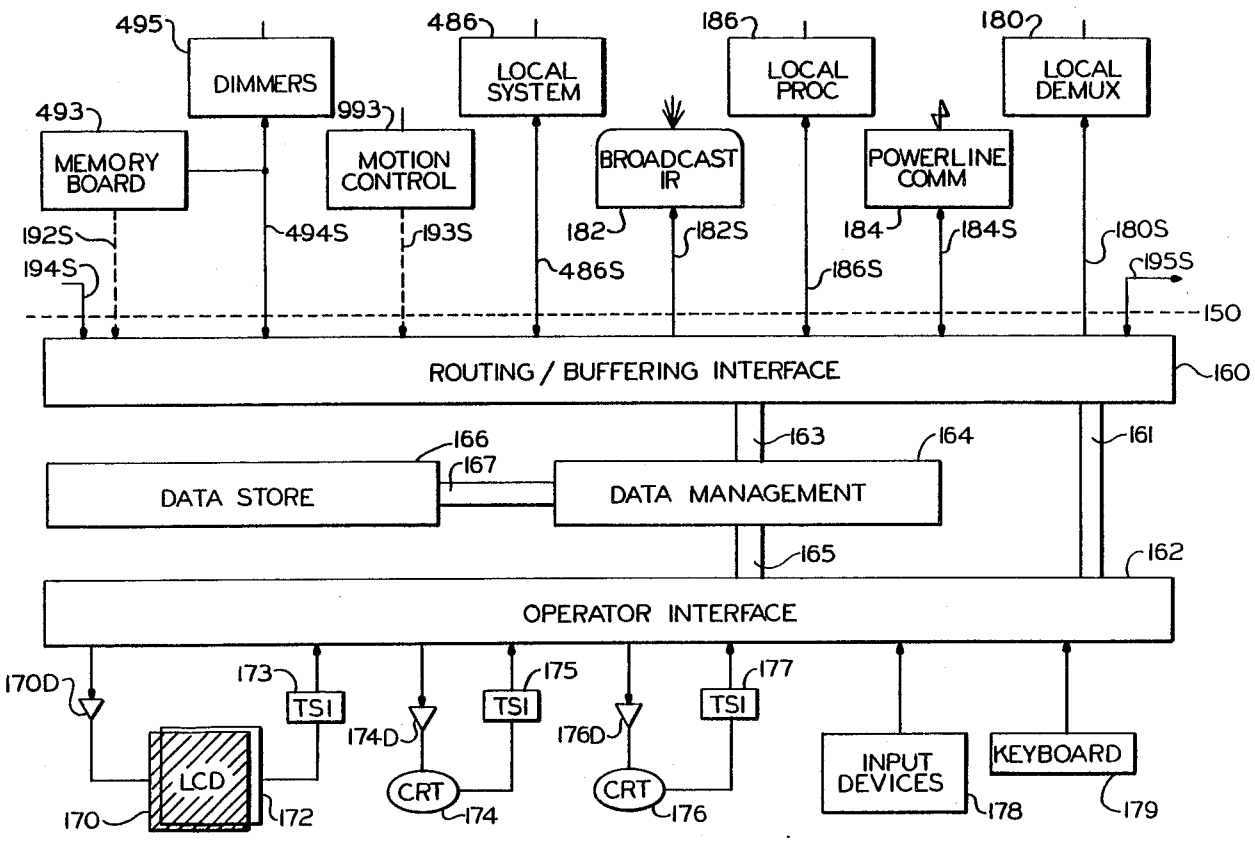
FIG. 11A is a block diagram of an improved control system suitable for use with the improved color mixing fixture of the present invention.
Figure 11B:
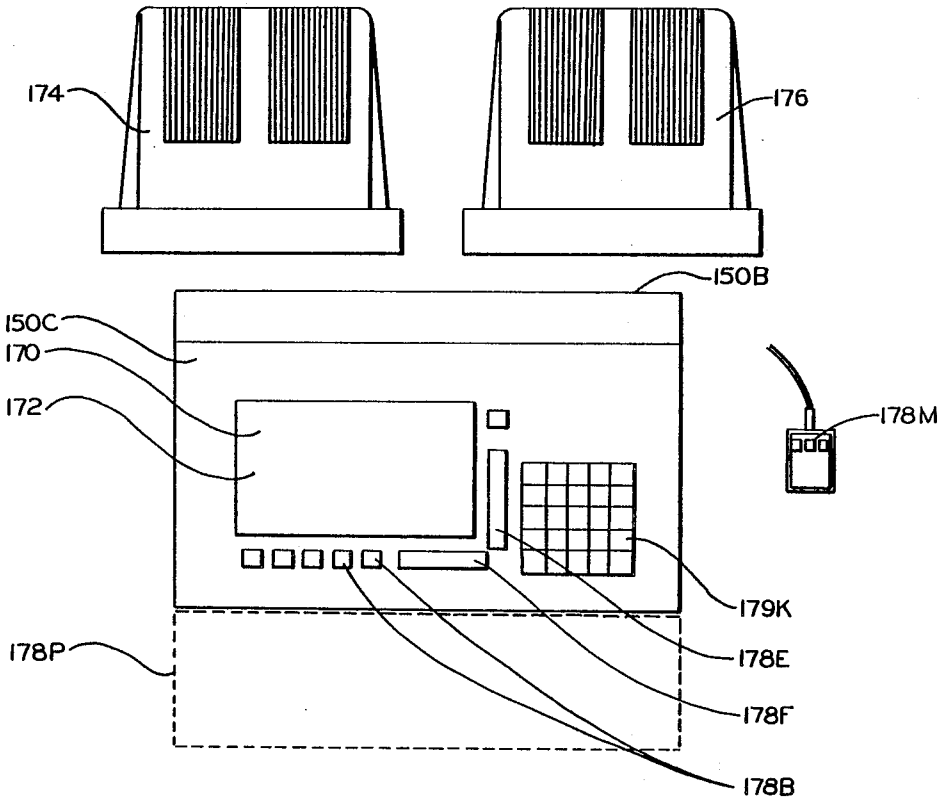
FIG. 11B is an elevation of one physical embodiment of the improved control system of FIG. 11A.

Refer now to FIGS. 11A and 11B where such a control system with such features, and to FIGS. 12 through 18 where such an interface is illustrated.

Control systems for a plurality of beam parameters per fixture face a variety of problems either not encountered or not encountered to a similar degree by control systems for conventional fixtures that are adjusted only in intensity.

One class of such difficulties relate to the need to mix different types and generations of automated fixtures and devices in the same system; each having different control requirements dictated by the type and number of beam parameters adjusted and the type of mechanism used to perform each such adjustment.

Another class of difficulties relate to the variation in the total number of automated fixtures and devices that can be employed in a single lighting system and the effect on the demands made of the centralized portion of the system of such variation. For example, in some cases 12–24 such automated fixtures are used to supplement an otherwise conventional lighting system; in other cases 60–300 such fixtures may represent the vast majority of all fixtures used in the lighting system.

Another class of difficulties relate to the requirement posed by such automated fixtures and devices for transmission of large quantities of data to the many spaced-apart locations at which the units have been placed, particularly given the previously-described variations in the types and numbers of such fixtures and devices.

Many of these problems have been described in greater detail in the grandparent application.

Another class of difficulties relate to the frequent requirement that such automated fixtures and devices be employed in combination with a large and variable number of conventional fixtures adjustable only in intensity; and that the response of both groups of fixtures be synchronized to achieve a unified effect.

Many of these difficulties have been described in the parent application.

Further difficulties are a product of the technical and human factors problems of programming, storing, and displaying values corresponding to movement, color, locations in space, and time.

Refer now to FIG. 11A and FIG. 11B, where the basic features of a control system employing various techniques that address these difficulties is illustrated.

The centralized portion of this control system constitutes those elements below dashed line 150, which will be referred to as the "controller" portion. The controlled fixtures and/or devices will be referred to as the "devices".

The illustrated controller may be coupled to automated fixtures or devices that employ any one of three approaches:

Local system 486 constitutes a local control system associated with one or more automated fixtures or devices; the design and operation of which has been described in the prior related applications.

Local processor 186 constitutes a microprocessor or state machine associated with one or more automated fixtures or devices, as for example, disclosed in U.S. Pat. No. 4,716,344. While such an approach to the control of the device does not store desired parameter values for a plurality of lighting effects, and is provided primarily for actuator control, it does provide some local intelligence.

Local demultiplexer 188 constitutes a hardware decoder such as disclosed in U.S. Pat. No. 4,392,187 with no local intelligence.

Devices incorporating all three approaches must communicate with the centralized portion of a control system.

While FIG. 11A illustrates that, in functional terms, devices employing each of the three approaches may be separately addressed by the controller via 486S, 186S, and 180S; at the physical level all three can share a common data transmission means by employing a communications protocol that supports multiple message types.

Such messages may be readily produced by means of a function byte, as is, for example, provided for in the United States Institute of Theater Technology (New York, N.Y.) "DMX-512" digital serial protocol for intensity values.

In some prior art centralized systems, one serial message/packet is sent with the desired parameter values for each fixture. Because of the sheer volume of data to be transmitted, two problems have been encountered and recognized. One is the requirement for a high-capacity and yet reliable data link. The second relates to the perceptable "ripple" in the execution of a common cue by a large number of fixtures connected to a common serial link caused by the time required to send new values to each.

Another difficulty relates to the problems of producing changes in parameter values that take place at a rate slower than the maximum slew rate of the appropriate actuator. In some systems, such changes are produced by the centralized, portion of the system, which (in the manner conventional consoles produce timed fades in dimming systems) calculates and transmits the desired state of each parameter for each fixture at regular intervals during the transition; considerably increasing both traffic on the data link and the computational workload on the centralized portion of the system during such transitions.

In the illustrated system, desired parameter values for each fixture are stored in data store 166. The system identifies the type of controlled fixtures and devices by means of the "polling" function described in the grandparent application. Specifically, the controller sends out a message to each allowed device address whose function byte identifies it as a query. Any device having that address responds with a message containing the codes representing the particulars of its design and operation.

This information is used by the console to configure the operator interface in the manner described below and to determine the responsibilities of console toward the device.

In the case of prior art devices with a local demultiplexer but no intelligence, a relatively simple hardware modification would permit them to respond to such a query. (The presense of devices that are not capable of responding or are on a simplex link can be deduced when the operator programs parameter data for them, and the input of data identifying the device can be made a precondition to the operator adjusting it.) On the basis of this identification of the device at a given address as having no intelligence, the controller understands that it will have to send parameter values as they are needed and calculate transitions for that address.

In order to eliminate the problem of "ripple" for local processor- and local demultiplexer-equipped devices, the illustrated system employs a technique disclosed in prior related application Ser. No. 443,127; the use of a separate "Go" command to initiate actual execution of a transition to values already present. Thus, the receipt of a message with desired parameter values by local processor 186 or by local demultiplexer 180 will not cause the initiation of a parameter value change—such initiation will be delayed until a common "Go" message is received by all connected devices.

Further, the selection of a new lighting effect at the controller as a pending "next" cue (whether by operator entry or its automatic loading as "next in sequence") will result in an automatic download of the associated parameter values to the controlled devices, such that the initiation of the next cue by the operator need only produce the "Go" message.

In the case of timed transitions involving either local control systems or local processor-equipped devices, the disclosed system downloads the duration value for the transition to the local system or processor, which is made responsible for metering the rate of parameter change to achieve that desired duration.

Identification of the device at an address as a local control system informs the controller that it can download parameter values for all cues to the device at power-up.

Therefore, the disclosed controller will respond to the loading of a cue into "next" position by transmitting messages with desired final parameter values and durations to only those addresses with local processors; and the first desired increment towards the final parameter values to only those addresses with local demultiplexers.

Upon the operator's initiation of the cue, the controller outputs a single "Go" message, which is sufficient to trigger the simultaneous execution of the transition to new parameter values by all connected devices having either local control systems or local processors. The controller may then devote its entire computational efforts and the data link to update messages to only those addresses with local demultiplexers.

The result is a uniquely flexible and efficient system that permits a controller and data link of relatively modest power to control a useful number of simple devices with no local intelligence; a larger number of devices with some local intelligence; an essentially unlimited number of devices with local control systems; and many intermediate mixes of the three.

The system disclosed in FIG. 11A also employs three data communications methods.

Digital serial communication has been used in automated lighting applications for many years. It does, however, require the distribution of a low-voltage serial data stream to the various controlled devices and despite radiated EMI from the line-level power wiring. Such distribution has required the use of special connectors and cables having no commonality with those already in use in conventional lighting systems; and in many cases the use of intermediate buffers. Therefore, the costs and practical difficulties of using automated fixtures and devices, particularly in large existing permanent installations, are increased significantly by the requirement for such cabling, connectors, and buffers.

The disclosed system employs a broadcast link between the controller and the devices. This may take any of many forms including an inductive loop around the space, ultrasonic or radio transmission, etc. Preferably, however, a broadcast infrared system 182 is employed that pumps digitally-encoded data into the performance area from one or more emitters. Such an approach requires no special cabling or connectors, and as such, can be readily retrofitted to existing installations at minimal cost. Very high data rates and multiple channels are possible, and the link is immune to radiated EMI.

Such an arrangement has the disadvantage of being simplex in nature, but the disclosed control system overcomes this difficulty by the use of powerline communications.

The transmission of digital data through an alternating-current distribution system has long been known and several manufacturers offer integrated circuits for the purpose. Low-cost versions of such systems have limited data rates, typically less than 2kbaud, which is clearly insufficient for the data requirements of conventional control systems.

As taught in the grandparent application, the low data rates of the distributed control architecture disclosed in the prior related applications permits the use of powerline communication in such systems.

In the case of the control system of FIG. 11A, powerline communication is used to close the loop between the devices and the controller for devices employing all three approaches 486, 186, and 180.

Thus, the controller, when employing the broadcast link rather than (or in addition to) conventional cabling, uses powerline communication for responses from the devices. The "polling" operation takes place with queries over both the broadcast system 182 and the powerline system 184. A device that receives a query with its address over both systems responds with a powerline message. Receipt of that response by the controller confirms not only the presense of the device but the functioning of both systems. Receipt of the message by the device over only the powerline system results in a response to that effect, causing the controller to prompt the operator that the broadcasts are not being received and the device must be checked. Receipt of a query message on neither system will produce no response by the device and the refusal of the controller to accept parameter values for or adjustment of a device at that address until the user corrects the problem.

During operation, the powerline system is used primarily for reports and responses from the devices, although it can be used for duplicate "Go" messages and for other low data rate messages.

The disclosed system addresses the requirement for synchronized operation with conventional lighting fixtures by two means.

The controller may, of course, provide for storing desired intensity values for conventional lighting fixtures, and a unique interface mode will be disclosed for that purpose.

However, the controller also provides a synchronizing port for a conventional lighting memory console 493 as disclosed in the prior related applications. This port is illustrated as employing a simplex fiber-optic link 192S to the conventional memory console. A similar fiber-optic link 193S is provided to any specialized motion control system 993 provided for scenery and rigging automation. The function of link 993S will be described in greater detail below. The controller is passive with regards both these products (that is, the link is incapable of carrying messages to either console 493 or motion control system 993) and a fiber-optic link is employed to prevent a transmission by the controller, RFI, or an electrical fault from accidentally triggering a motion control cue.

A synchronizing port for other known protocols such as SMPTE, MIDI, and/or ESBus is provided via 194S.

The disclosed controller also provides for the control of the intensity of connected automated fixtures by an outboard conventional lighting control console as was disclosed in prior related application Ser. No. 443,127.

In the past, some control systems for automated lighting fixtures have sent one message for each fixture address, that message containing the fixture address and all parameter values including intensity. In the disclosed control system, intensity values are transmitted in separate messages/packets using a conventional format with intensity values for all addresses in a single message (e.g. DMX-512). Other parameter values are sent in other messages.

There are several benefits to this approach:

First, intensity values are more frequently changed and require faster response than values for other parameters. The use of specialized intensity messages that update all intensity values simultaneously maximizes the speed with which the fixtures respond to intensity changes. Further, when the output of the conventional console is accepted in serial form, no effort is required to strip each intensity value out, store it, and insert it into the next outgoing message to that address—and no delay is incurred in doing so. Instead, the serial output of the conventional console 493 can be coupled more or less directly to the data link to the automated devices, requiring only that the controller interleave its messages in the stream, omitting entire intensity messages as required.

Further, the address of the automated fixture for purposes of intensity control can, very desirably, be different from its address for other parameters.

Where the automation controller serial protocol is compatable with DMX-512, dimmers for conventional fixtures also be coupled to the same data link.

The illustrated controller provides an input port for the serial output of a conventional memory board 493 via serial link 494S.

Such an arrangement does not prevent the controller from determining and/or modifying intensity values, which can be readily edited between input from the conventional control console 493 and output to the automated devices.

Another benefit of the separation between intensity messages and parameter messages is the ability to reduce data rates by sending parameter values only when they change, or at least relatively infrequently. Because a parameter value message garbled in transmission will be held for some time (rather than being quickly corrected by the next transmission) error-checking is essential.

In the preferred embodiment, the disclosed system stores individual records of each change to a parameter value rather than recording the state of every parameter value of every fixture after every cue.

Each "record" in the data store includes six primary fields: the device address; the parameter affected; the new parameter value; the time required for the transition to that value; the event that initiates the change; and the delay, if any, between the event and the initiation of the change.

Such records can be indexed by device, parameter, and/or event.

The use of a separate record for each parameter of each device address for each event produces economy in storage; flexibility in adapting to different device types; and the ability to accomodate cues of exceptional complexity.

In the disclosed system, the current state of any device is a result of the last change to each controlled parameter, and the current state of the lighting system is a product of all previous changes executed. For this reason, new cues can be created and inserted in an existing sequence without affecting other devices or requiring the creation of "bridge" records for such devices, as the last value will "track" in the known manner. Further, changes in parameter value can be presented to the operator as abstract macros; that is, having defined a change of condition for one device, the operator can "copy" that change to any number of other devices. The operator can also copy such changes/macros with modifications including offsets.

The disclosed system also provides a serial port for data transfers with external devices via link 195S.

The adjustment of a plurality of beam parameters present unique problems with an efficient operator interface relative to those confronted by consoles adjusting only intensity.

To address these problems, the disclosed controller employs at least one interactive visual display.

In the illustrated embodiment, this takes the form of a flat panel display 170 (such as an EG8003 LCD unit as manufactured by Epson America Inc., Torrance, Calif.), which is driven by a Yamaha Display Master controller 170D (Yamaha Corporation of America, Buena Park, Calif.); and at least one conventional CRT (here, two CRTS 174 and 176) driven by any suitable display controller (174D and 176D). At least one such display is provided with a touch-sensitive surface 172 (such as manufactured by Carroll Touch Inc, Round Rock, Tex.) and its associated controller (173, 175, and 177). Many pointing technologies are possible including membrane, resistive, capacitive, and acoustic sensing of either the operator's finger or a stylus. Virtually all such touch input systems are provided as standalone units which output an X coordinate, a Y coordinate, and a presense signal. Several manufacturers supply software programs to produce an interactive visual display that may be directly interfaced with existing applications programs.

The disclosed system provides for one or more additional input devices 178, here including a three-button mouse. There is also provision for a keyboard 179.

Refer now to FIG. 12–20, where views of various screens that may be displayed by the disclosed system are illustrated.

Fixture Selection

The first requirement of the operator interface of an automated lighting controller is a means to identify and select the fixture or fixtures to be adjusted.

In virtually all prior art memory systems controlling conventional fixtures, adjustment requires the selection of the appropriate control channel by number. In conventional lighting systems the direction, color, size, and shape of each fixture's beam are fixed, so that the identification of each control channel is simplified by the fixed parameters of the fixture or fixtures it controls (e.g. Channel #54 is the Downstage Left Red Backlight). A written table or "magic sheet" that relates such names to channel numbers allows the user to determine the less memorable channel or fixture number from the function or name. Some such control consoles provide a method (whether handwritten labels in the case of manual consoles or alphanumeric capability in the case of some memory systems) to physically associate the two identifiers at the point at which the variable parameter is adjusted (at the fader) or displayed (on the CRT).

In an automated lighting system, multiple parameters of the fixture being adjustable, no such method of channel/fixture identification is possible. The fixtures may be identified by number, put such a designation has few associations for the user and hence takes considerable time to master, if, in larger systems, it is practical at all. Otherwise, the time-consuming consultation of a diagram of the lighting system to determine the number of the desired fixture is required.

As a result, U.S. Pat. No. 3,845,351 discloses a control console that disposes the fixture controls in a "dummy schematic of the arrangement of the floodlights" in the theater or studio.

In the Vari-Lite Series 100 automated lighting control system generally disclosed in U.S. Pat. No. 4,392,187, fixtures were selected for adjustment by means of a matrix of numbered pushbuttons 182, but when users were confronted by the problems of selecting fixtures solely by number in practice, the system was modified to provide a CRT display programmed with a simple schematic of the layout of variable parameter fixtures. The operator then selected a given fixture by the use of cursor control keys.

Figure 12:
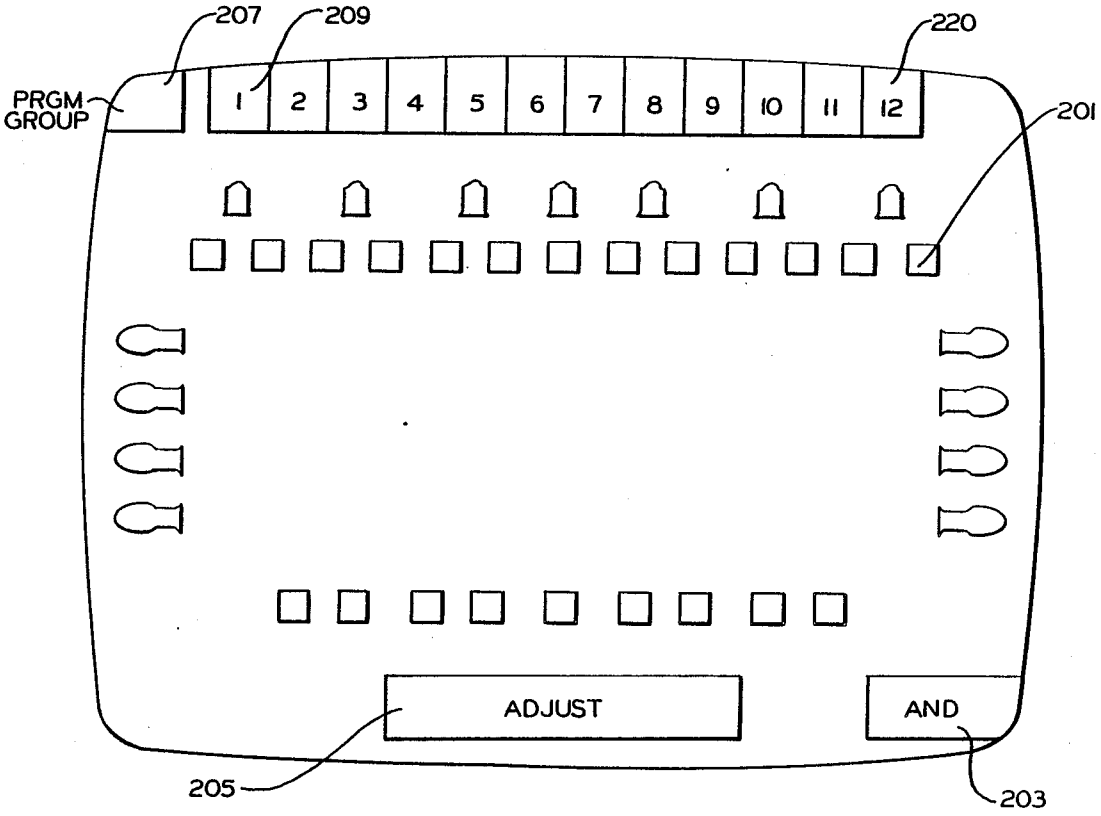
FIG. 12 is a fixture selection screen as may be produced by the interactive visual display of the improved control system of FIGS. 11A and 11B.

As illustrated in FIG. 12, the interactive visual display of disclosed control system presents a screen with a graphic presentation of fixture positions. The interactive nature of interface allows the operator to select the desired fixture simply by touching the appropriate symbol 201 on the display (or by designating it with the input device 178). The selected fixture may be indicated by flashing, reversed video, or a change in color or intensity. As illustrated, different types of adjustable fixtures may be indicated by different symbols.

A plurality of fixtures may be selected for simultaneous adjustment by any one of several methods. Given a Fixture Select Mode that automatically switches the display to a Fixture Adjust Mode upon selection of a fixture, the addition of an AND field 203 forces the display to return to the Fixture Select Mode. Alternatively, the interface may remain in the Fixture Select Mode until the use of an ADJUST field 205 to trigger the mode change, which would allow unlimited fixture selections.

Further, the illustrated interface anticipates the designation of groups of fixtures to simplify the programming of repetitive adjustments. By means of the PRGM GROUP field 207 the user can, by the same method of fixture selection described above, designate groups of fixtures and associate them with GROUP fields 209–220. These groups may be identified by a common, arbitrarily selected color, symbol, or brightness level. Thereafter, touching any GROUP field will cause selection of all fixtures in that group. Fixtures may be added to or deselected from a group for purposes of an adjustment operation without reprogramming them in the group store by touching (or designating) the symbols associated with the desired fixtures, toggling them on or off.

It will be understood that the selection process may be employed not just for variable parameter fixtures but for those varied only in intensity either by the same control system or by an external device such as a more conventional memory system via an interface.

The graphic display of fixture positions may be composed by the user in any known manner, in this case using the same "touch" process and/or the input device 178. Alternatively, the system may accept the direct entry of a display of fixture positions prepared by a drafting system such as Source Point TM, AutoCad TM, or Show Plot TM by means of disc, modem, or serial port 195S. Other benefits of the interaction between such drafting packages and the operator interface will be described.

It will be understood that a presentation of the entire lighting system may, in some cases, exceed the useable resolution of the display and/or the touch interface and, accordingly, zooming, windowing, and similar approaches may be employed for display management.

Upon selecting the fixtures to be adjusted in a given operation, the interface and display is driven to an Adjust Mode either by automatic means (a fixture selection) or by operator input (ADJUST box 205 or an actuator surface on the input device).

Parameter Adjustment

The design of the Adjust Mode display will vary as a function of the parameters to be adjusted and the type of mechanisms employed by the fixture for that adjustment.

Figure 13:
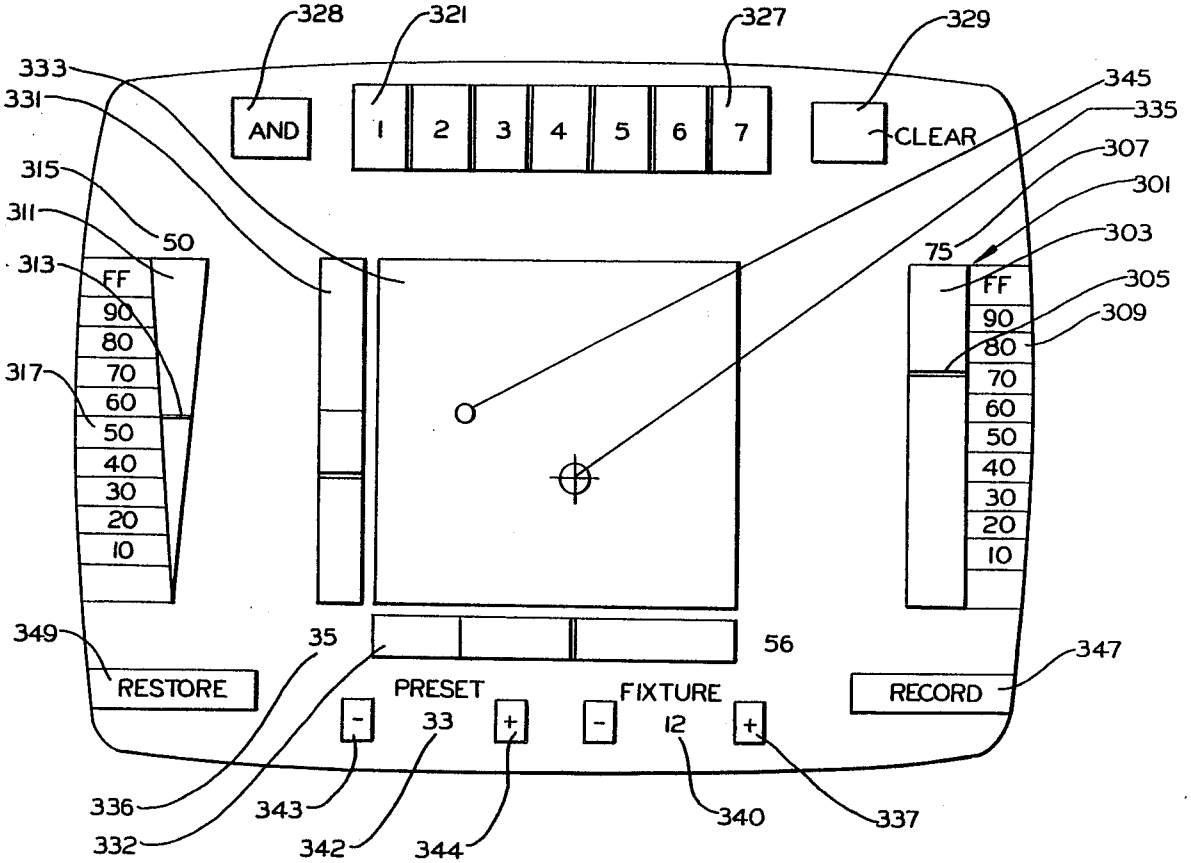
FIG. 13 is a fixture adjustment screen as may be produced by the interactive visual display of the improved control system of FIGS. 11A and 11B.

FIG. 13 illustrates a single display screen suitable for the adjustment of all parameters of one type of multivariable fixture.

Intensity is adjusted by bar 301, whose graded intensity from bottom to top corresponds to the range of adjustment. Intensity can be continuously adjusted in analog fashion by touching or designating points along field 303, the current value indicated by a pointer 305 and by a digital display 307. Because it is frequently desirable to set fixtures to precise values, additional fields such as 309 provide a stepped sequence of fixed values. It is clear that a function can be readily be provided that allows resetting the assigned values.

Beam size, here shown as capable of continuous adjustment, may be selected by bar 311, whose shape illustrates the range of possible values. Again, the current value may be indicated by a pointer 313 or by a digital display 315. Additional fields such a 317 allow setting fixtures to precise sizes. Such fixed values may be reset to other values by the operator.

Beam color, here shown as adjusted by a semaphore type changer, may be selected by toggling on the fields for the desired color changer frames. To improve operator efficiency, the color of these fields 321–327 in the display, may be readily programmed to correspond to the color filters they control, preferably in a System Setup Mode, described below. The position of each filter may be indicated by partial or complete field coloring. An interlock function may be provided to automatically cancel the previous selection upon a new one; an AND field 328 permitting multiple filter selections, and a CLEAR field 329 resetting all filters to the inactive position.

Beam azimuth and elevation may be adjusted by separate bars 331 and 332 similar to intensity bar 301 or size bar 311. Preferably, a field 333 provides a non-mechanical two-axis input device as disclosed in U.S. Pat. No. 4,460,943. Current azimuth and elevation may be indicated graphically by a moving symbol 335, or by digital displays 336 and 337 as disclosed in U.S. Pat. No. 4,527,198.

Other relevant data such as the fixture number 340 and the preset or cue number 342 may be indicated elsewhere in the display; and fields associated with them, such as fields 343 and 344 allow incrementing and decrementing them.

The illustrated operator interface allows the simultaneous display and adjustment of parameter values with high degree of operability, at equal or lower cost than prior hardware-oriented systems, and with a fraction of the maintainance requirement of such switch, indicator, and manual control arrays.

Further, the illustrated operator interface allows the simultaneous display of a previously recorded condition and of a new condition or adjustment prior to rerecording.

Consider, for example, the adjustment of azimuth and elevation for Fixture #12 in Cue #33. Upon selecting the fixture either from the Selection screen illustrated in FIG. 12 or by entering its number directly, the operator is presented with the display of FIG. 13. A symbol 335 provides a graphic indication of the recorded azimuth and intensity. The operator readjusts azimuth and elevation by use of field 333 in either the absolute or incremental modes described in U.S. Pat. No. 4,460,943. The new, temporary values are indicated by a second symbol 345 and, if the cue is active onstage, the fixture will assume them. Should the operator wish to rerecord the new value, he touches the RECORD field 347. The recorded position symbol 335 will replace the new value symbol 345 at the new values. If the operator wishes to retain the previously recorded value, he or she touches the RESTORE field 349 and the temporary value is cleared.

Another benefit of the illustrated operator interface is the unique ease with which the number, type, size, location, and design of the adjustment means can be altered to suit the needs of both the operator and the controlled device. Unlike prior art systems with hardware interfaces, the illustrated operator interface can be redesigned at insignificant cost, and indeed can be altered from moment to moment. In a system controlling a combination of color changers, remote yokes, and multi-variable fixtures, for example, the device selected by the operator can readily determine which of a plurality of Adjustment screens the operator is presented with, each such Adjustment screen optimized for the requirements of the particular type of fixture selected.

Figure 14:
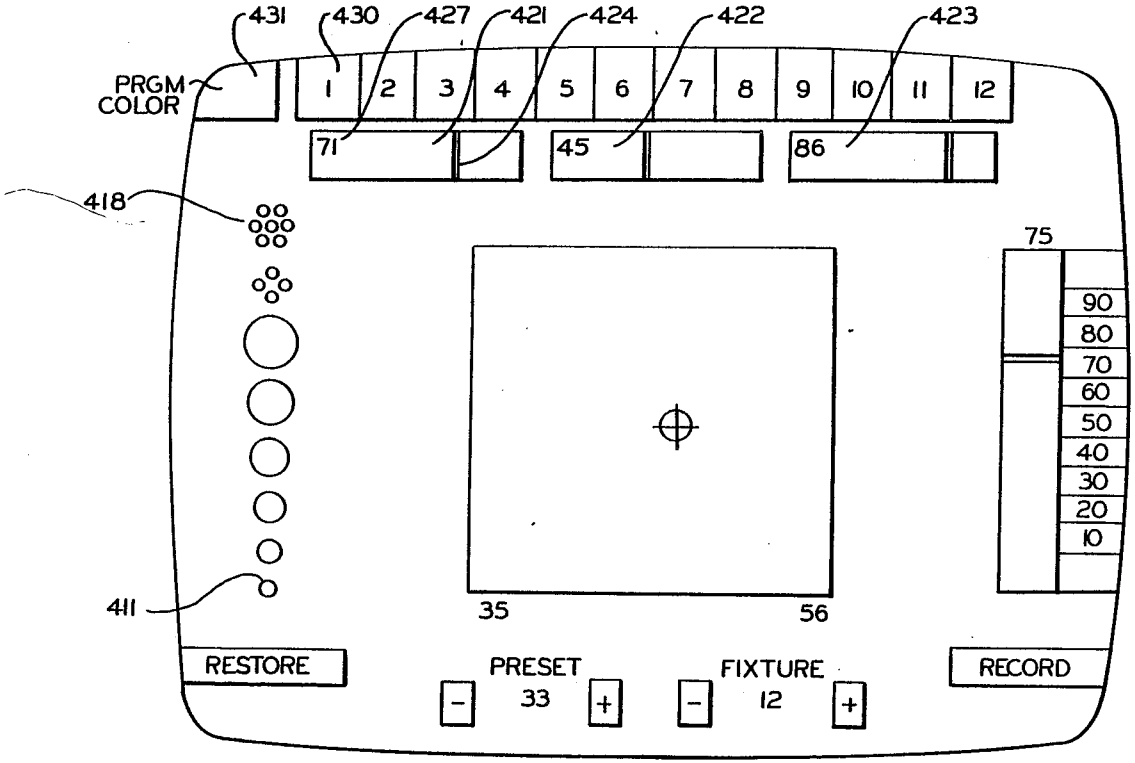
FIG. 14 is a fixture adjustment screen as may be produced by the interactive visual display of the improved control system of FIGS. 11A and 11B providing for direct adjustment of the three additive primaries.

Refer now to FIG. 14 where the Adjustment Screen for another type of multi-variable fixture is presented.

Intensity is adjusted by bar 401 in a manner similar to that of FIG. 13.

Beam size is, however, adjusted in discrete steps by means of an aperture wheel, and as such, this section of the screen provides a series of fields 411–418 each corresponding to an aperture.

Beam color is adjusted by a continuously variable elements such as a trichromatic filter set, and accordingly bars 421–423 provide direct adjustment of each filter set with an analog display of the selected value by pointers such as 424 and digital displays such as 427. Because the operator will wish to program certain desired colors quickly and accurately, a series of fields such as 430 that may be preprogrammed with desired combinations of the three color variables using the PRGM COLOR field 431 are provided.

In addition to the separate adjustment of each filter in a system, color control adjustment may also be provided by a two-axis field in which both color and saturation are simultaneously adjusted (for example, by changes in location within a CIE chromasticity diagram) with software conversion to the required values for each filter. It will be recognized that a system that adjusts these two values directly, such as illustrated in FIGS. 5A–10B, will require comparatively little conversion.

In FIG. 14, azimuth and elevation are adjusted in a manner similar to FIG. 13.

When the two types of fixtures are mixed in a common system, the selection of a fixture of a given type from the Fixture Selection screen of FIG. 12 will present the operator with the Adjustment screen appropriate to the type. It will be understood that fixture type may be manually entered by the operator, but is preferably performed automatically by the previously-described "polling" and responses from the fixtures and devices. Further, as has been previously described, the color filters and gobos installed in a fixture can be automatically identified by sensing either spectral transmission and/or codes of each filter or gobo and this information can be used to determine the color of the field associated with the filter and the symbol presented for the gobo automatically.

It will be understood that the display and adjustment of azimuth and elevation anticipates both the direct adjustment of these values and the adjustment of values corresponding to them but expressed as the absolute location in space at which the beam is desired. Such conversions, described in the grandparent application, may be performed centrally or at the controlled device in either the central or distributed architecture.

Figure 15:
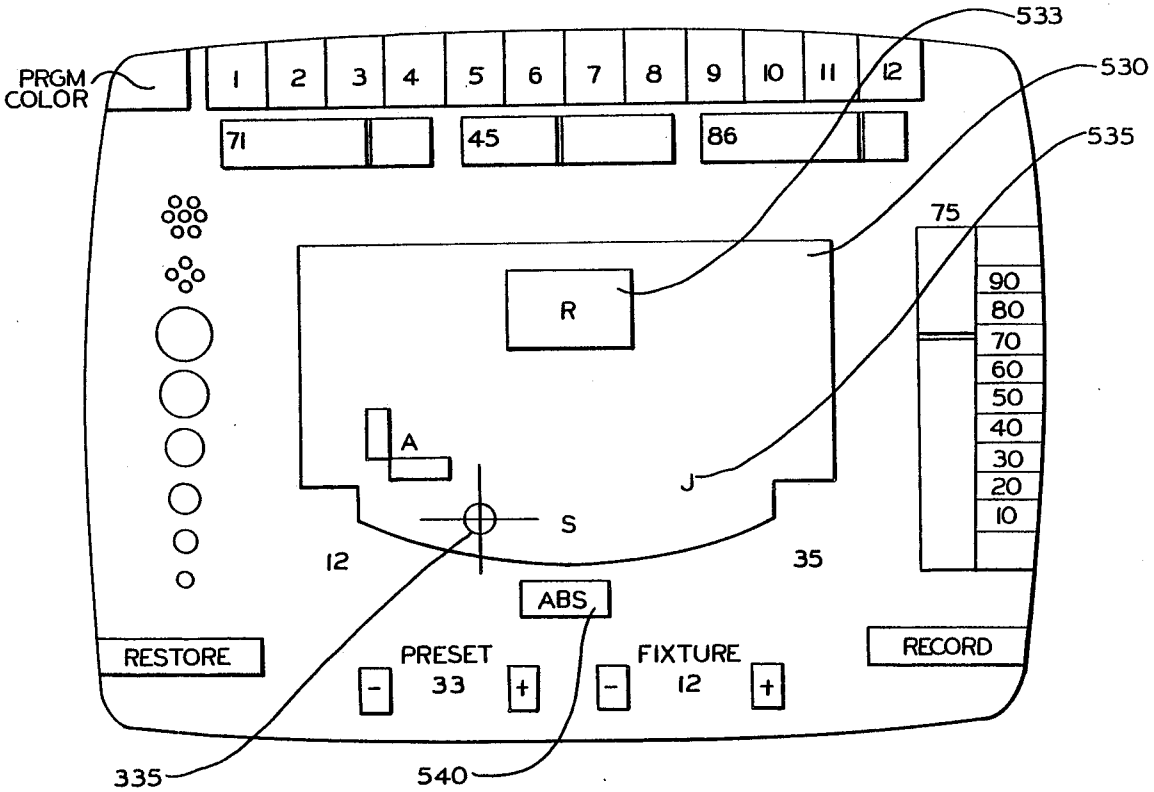
FIG. 15 is a fixture adjustment screen as may be produced by the interactive visual display of the improved control system of FIGS. 11A and 11B providing for adjustment of the intersection of the beam with the stage surface.

In a system employing such adjustment, the desired azimuth and elevation may be programmed with the display of FIG. 15, the field 530 representing a diagram of the stage area, with or without rules or symbols identifying specific objects or locations on it. The operator, using finger, stylus, or input device, adjusts azimuth and elevation in the same manner as the previous Figures.

Display of Stored Parameter Values

In a system employing the illustrated operator interface, the display of recorded values and particularly the adjustment of those values to create new stage pictures either in response to unpredictable developments in the performance or as a method of building new stage pictures is considerably simplified. Most prior art systems, if they are capable of displaying recorded values at all, are incapable of displaying them except in digital form, a form of presentation with little meaning for the operator.

A Stage or Preset Display screen, similar to that of FIG. 12 can graphically indicate the condition of the fixtures in a cue. Fixtures with beams shut off can be represented in outline only, while the symbols for active fixtures change to the color selected for those beams. The parameters of any fixture can, of course, be displayed by touching or otherwise designating the appropriate symbol, which presents the Adjustment Mode screen for that fixture with current or recorded values, and allows readjustment by appropriate operations in that mode.

Figure 16:
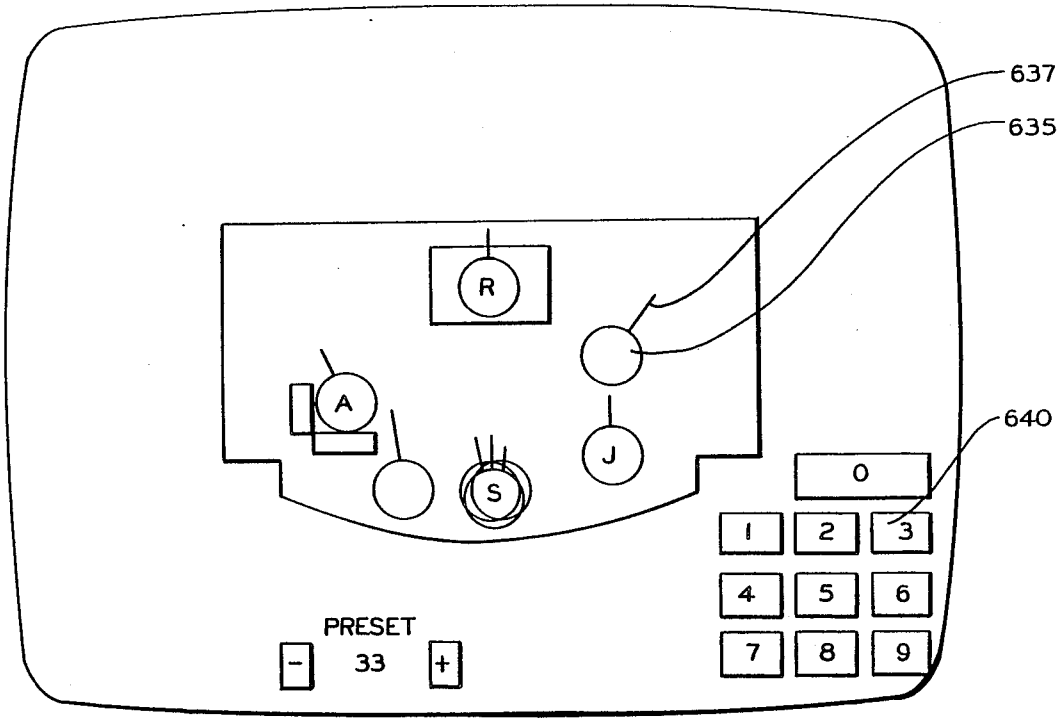
FIG. 16 is a cue preview screen as may be produced by the interactive visual display of the improved control system of FIGS. 11A and 11B permitting the operator to determine the size and relative horizontal and vertical angles of the light beams illuminating any point on the stage surface.

However, in embodiments of the disclosed control system recording absolute values, another form of display as illustrated in FIG. 16 is also practical.

The recording of desired beam location onstage allows the display of such locations on a representation of the stage in the prior art manner. But a far more useful form of display includes not just position information, but other recorded values. Fixture symbols, such as 635 can adopt the color of the fixture beam (or an outline if the beam is extinguished) and change size according to recorded value (whether in arbitrary increments or by computation of beam spread).

To comprehend the visual effect of a given preset it is desirable for the operator to determine the direction from which each beam reaches the subject. In the only prior art system to graphically present beam location onstage, this requires identifying both the fixture responsible for lighting each subject from the identifying number within its position symbol; establishing the relative location of the fixture itself (by consulting memory or a drawing of the fixture layout); and then mentally comparing the two.

In the disclosed operator interface, lines could connect the symbol with a graphic display of fixture positions similar to that of FIG. 12 superimposed over the stage diagram or wrapped around its perimeter. However, such a presentation would be cluttered. More practically, the desired information can be provided with a line such as 636 indicating the direction of the fixture, the line length varying inversely with the vertical angle to it.

Modifying Recorded Values from a Full Stage Display

In the disclosed interface, the operator can select the fixture desired for adjustment by simply touching its beam symbol, changing its location by "dragging" it to the new one, and its remaining parameters by means of touch fields around the perimeter of the display. Preferably, upon touching the symbol associated with a given fixture, the display would change to an Adjustment screen such as shown in FIG. 15. When the operator removes his or her finger, the symbols for the remaining fixtures would return.

Entry of Setup Data

The system of the present invention does require the entry of specific data identifying the fixtures used, their type, location, and for certain interface features, data such as color filter selections.

Figure 17:
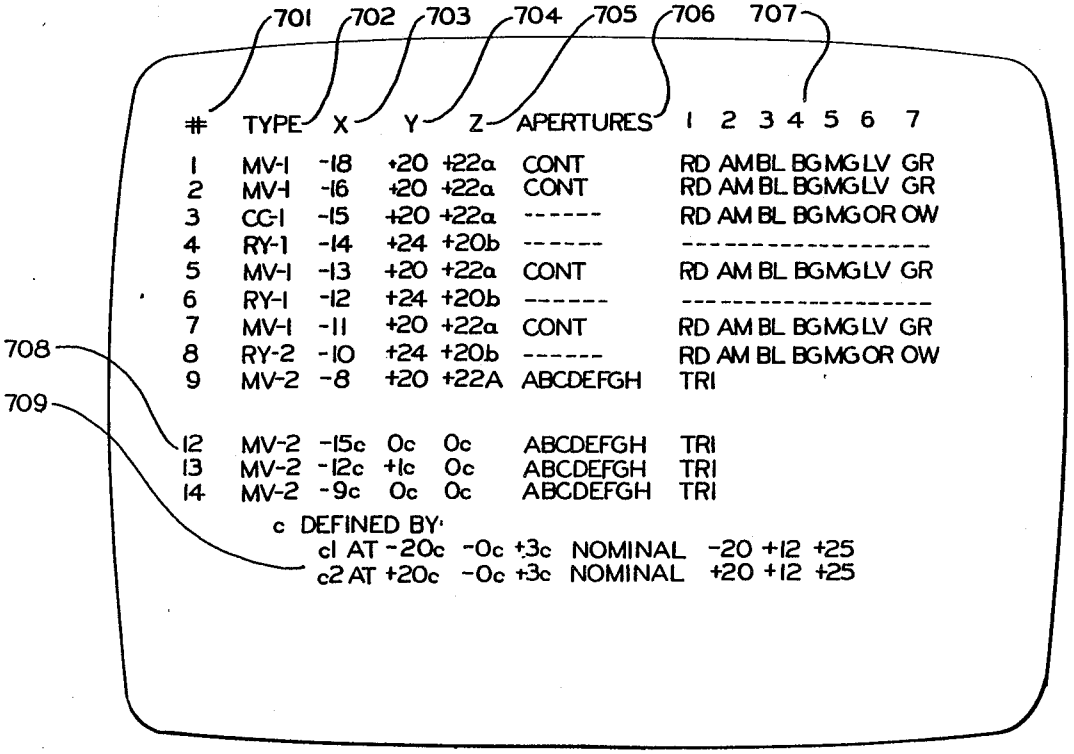
FIG. 17 is a device definition screen as may be employed by the improved control system of FIGS. 11A and 11B to input the relevant specifications of each controlled device.

This data may be entered by one or more of several methods, and displayed in tabular form as illustrated in FIG. 17.

Controlled devices are identified by number in column 701 and by type in column 702. This data may also be automatically entered by one of two methods: the input of data from a drafting package such as previously described, or (as previously described) by querying controlled devices over the data link by number, the device assigned to a given control channel (by means of its local address decoder switch or function) responding with its type, model, and software revision as well as filter and gobo selections, where they can be sensed.

Device location may be specified in three dimensional space in columns 703, 704, and 705. The "X" dimension is distance stage left (+) or stage right (−) of the centerline. The "Y" dimension is distance upstage from the nominal front edge of the stage, and the "Z" dimension nominal height above stage level. Other notation systems are possible. Given these values, it is possible, as described in the grandparent application, to specify azimuth and elevation values in absolute position (with X, Y and implied or stated Z) and for the system to calculate the azimuth and elevation required to intersect that location. Entry of device location in numerical form also permits the automatic composition of a fixture selection display as shown in FIG. 12.

Further, it will be understood that automated drafting systems such as those described, by their nature, develop at least the "X" and "Y" values, and that the automatic input of data from such a system would include not only fixture number and type but available location values as well.

Updating of Position Data

Where devices are attached to a support (such as a truss) that may move with respect to the stage either from setup to setup in a touring production and/or for effect during the performance itself, updated position data is required for the absolute to azimuth and elevation conversion function. Where several devices are attached to a common support (hung on the same truss), the entry of revised position values can simplified by designating those devices attached to the same support, here by means of the lower-case letter appended to the "Z" value. Thereafter, "Z" values for all devices in the "a" group may be modified by entry of "Za=24" "X" and "Y" values may also be updated in similar form.

A notation system that allows more complex movements of the support system is illustrated in the case of devices 12–14 identified as 708. Device position is specified relative to an arbitrary center point of the support structure. At least two points are specified whose position in absolute terms with respect to the stage is either known or can be inferred. In this case, these points c1 and c2 are preferably the motors used to raise and lower each end of the supporting truss, and their locations relative to the arbitrary center point are specified in the same terms at 709 (here shown as 20 feet from and 3 feet above center). The absolute location for the known points c1 and c2 are entered (here 20 feet to either side of center, 12 feet upstage, and 25 feet above it). Offsets relative to these known positions having been specified, the absolute location of any controlled device can be calculated. When the supporting structure moves, only the change in position of points c1 and c2 need be altered to update each device location.

It will also be noted that the position of the reference points can e determined with the aid of methods like ultrasonic ranging and angle or inertia sensors. As noted in the grandparent application, the location of fixtures can also be determined by manually adjusting their beams to intersect either a known location onstage or two points a known distance apart, a setup program allowing the system to calculate the location of the fixture in three dimensional space from the angles required. Given the known offsets of the remaining devices previously entered, the absolute location of any device or reference point can be determined.

As noted in the grandparent application, there are advantages to "jobbing out" the absolute to azimuth and elevation conversion to the local devices, and in such a control system, this notation system permits the updating of absolute position for all controlled devices in the "c" group with no more workload on the central system or data link than regularly transmitting three revised location values for c1 and three for c2.

Further, such updates can be provided automatically.

The chain motors supporting the truss, for example, may be equipped with encoders in the prior art manner, by which the "Z" location of the chain motor may be determined by a control system 993 for the motors. The improved control system disclosed anticipates automatically providing the same data to the variable parameter system via a data link 193S. Indeed, the improved system architecture disclosed in the prior related application may also include local control systems optimized for motion control rather than lighting control. The common data link between the various lighting and motion control local systems allows the synchronization of lighting and motion cues by outputting a common cue number from the supervisory unit. Similarly, running position updates used to maintain the focus of fixtures on moving supports with fixed subjects onstage, fixtures with subjects on moving scenic elements, and fixtures on moving supports with subjects on moving scenery may be transmitted through either the common data link or a separate channel. A degree of coordination heretofore unprecedented may therefore be achieved with minimal workload on the centralized portions of the system and on communications requirements on the buss.

Due to the dangers of the triggering of the wrong motion control cue or the correct cue at the wrong moment, whether by operator error or an electronic fault, the motion control system is separate from the lighting control system; connected by a fiber-optic or other link that will not transfer electrical noise or faults that might lead to actuation of the motion control system; and the operation of that link is entirely simplex, the motion control system 993 informing the controller of the execution of any cue and the location/status of its loads. The controller (and the memory board 493 for conventional fixtures) may, therefore, be triggered by the motion control system to produce a lighting effect in synchronism with a scenery move, but, as a matter of basic policy, the motion control system cannot be triggered by any operation of the lighting control system.

Similarly, where it is desirable to automatically track a moving performer and a system sensing the location of the performer is employed, position data produced by the tracking system may be employed by the variable parameter control system in the manner described.

Plural Forms of Storing Values Corresponding to Azimuth and Elevation

It should also be noted that the improved control system disclosed ultimately anticipates the capability of storing for each device in each cue, a value corresponding to azimuth and elevation in any one of three selected forms: beam azimuth and elevation, absolute location, and symbolic location.

While absolute location storage does eliminate the requirement for rerecording every cue when the position of the fixture's support with respect to the stage changes (provided the fixture position is updated) there will remain certain cues (such as symmetrical arrangements of fixture beams in the air) that should not be "rescaled" from performance to performance; or which such a system of notation simply does not allow (such as beams focused into the ceiling). Therefore it is anticipated that the user may select either the azimuth and elevation or the absolute mode at the Adjustment screen level, by means of a field 540, the central portion of the display toggling between fields similar to those of FIG. 13 and FIG. 15 depending upon the operator's choice, the type of recorded value suitably identified in memory.

It will be further understood that most of the azimuth and elevation values entered by the operator (whatever form they take) are for the purpose of focusing the beam on a subject onstage rather than an absolute location. That is to say, his or her object is to direct the beam on a performer or a scenic element, an object which he or she attempts to meet by programming the values for the absolute location at which that subject is generally found. Yet during the course of the rehearsal of a presentation; during a series of performances; or during the performance itself, the location of the performer or scenic element may change. This change may come as the result of an accident; a deliberate alteration in the artistic design of the production; or to compensate for changes in the physical environment (e.g. a smaller or shallower stage). Rewriting those cues in which azimuth and elevation data must be altered to compensate is exceptionally difficult as no system storing azimuth and elevation values provides a ready means to identify which fixtures in which cues were focused on that subject.

For this purpose, the system of the present invention also anticipates recording azimuth and elevation values in symbolic form.

A symbolic value is one without fixed correspondence to either a specific absolute location or to azimuth and elevation setting.

A symbolic value would preferably be entered by the operator in alphanumeric form, permitting the use of abbreviations having associative value such as "DSC", "ActII/S3 Alto", or "Drums"although more concise arbitrarily-selected binary values might actually be stored.

Symbolic locations may be specified by selecting an absolute location on the stage by means of either the input devices or keyboard entry and by specifying the identifying code or abbreviation. These two values are entered into a lookup table. Thereafter, selection of that location for a given fixture in a given cue would result in the storage of the binary value assigned to that symbolic location, rather than the absolute location or the azimuth and elevation required to intersect it. Upon playback, the system, upon recognizing the value recorded for a given fixture as symbolic, would consult the lookup table for that symbolic value and pass the associated absolute values to the absolute to azimuth and elevation conversion means.

It will be apparent that this system of symbolic values allows the revision of recorded location data for any subject on the stage in all cues by the simple expedient of modifying the entry in the lookup table, with no search for or change of the actual fixture cue data.

It will be further apparent that the symbolic value provides a "key word" on which a search of the database that the cue data comprises may be simply organized, as limited by any other value or combination of values (e.g. Show all cues in which fixtures 1–12 are focused on the keyboard riser. Show all cues between cue 50 and cue 75 in which a light is focused on the conductor. Identify the cue in which one blue light and one red light are focused on the downstage area.)

It will also be apparent that the symbolic value system simplifies the "patching" of variable location data from an input (such as a moving performer or performer on a moving scenic element) to those fixtures assigned in a given cue to tracking that performer. By specifying the location as an input rather than an absolute position (e.g. Wagon3=Input4 instead of Wagon3= −14 +21 +1) positional data can be automatically and constantly updated.

It will further be apparent that the symbolic system also provides a method of producing a "poor man's" absolute location to azimuth and elevation conversion method. Prior art approaches to the conversion of absolute location to the azimuth and elevation values necessary to intersect that location have been based on the real time conversion from one format to another at a fairly high update rate. This, in turn, produces a considerable processor workload which increases geometrically with the number of controlled fixtures. Preferably, this is performed by the local processor for each fixture. Where such a strategy is not possible (for example, in trying to "retrofit" this capability to fixtures having no local intelligence) and the centralized portion of the system must perform the conversion, it is clear that processor resources during a performance can be husbanded by "preconverting" the absolute locations to azimuth and elevation values prior to the performance for all fixtures whose own location will be known. But, as the number of locations to which a fixture beam will move in a show is generally far less than the number of cues, it is only necessary for the system to calculate the azimuth and elevation values required for each symbolic value for which the fixture is programmed, and to enter those values in a lookup table. This reduces both processing time and memory requirements of a "preconversion system". Clearly, the drastic reduction in processor requirements over a system which recalculates for all fixtures ten times per second provides enough unused processor power for those real time calculations that may be required by manual overrides of recorded positions.

Programming Time

It will be understood that the time it takes for the fixture to change between two sets of adjustments is frequently as important to achieving the desired effect as are the adjustments themselves. Conventional memory consoles employ a technique in which a "cue" defines the start of the change and a "count" specifies its duration, although this technique is relatively inflexible with regards more complex cues in which various changes start and end at different times with different durations.

In such systems, changes are assigned a start point with a numerical value (e.g. 35), the "cue number". New start points can be created between two already assigned by a "point" system (e.g. 35.5 can be inserted between already recorded 35 and 36), again conventionally. A duration can be associated with a given cue/start time (e.g. 35.5:3 is a change with a duration of 3 seconds starting at 35.5). In the disclosed system, such durations may be recorded for each change in a parameter by each fixture in the cue. As described in the grandparent application, applicant's improved architecture reduces the prior processor power constraints on such highly complex cues.

To increase the flexibility of the time notation system to accomodate more complex cue structures, a system should allow notation of start times relative to other start times (e.g. 35.5+4:3 is a change beginning four seconds after 35.5 and lasting three seconds). With such a system, highly complex effects can be designed with built-in synchronization between various fixtures linked to a common start point, using a more flexible system of time notation that permits different start times, durations, and end times. Further, the system should also permit substituting an event time rather than a duration for a cue (e.g.35.5+2..35.6 is a change beginning two seconds after 35.5 and lasting until 35.6 starts).

Graphic Representation of Cues and Cue Relationships

The presentation of complex relationships between multiple cues, particularly in lighting control systems that permit execution of multiple cue sequences simultaneously, has been a difficulty since such control systems were first introduced.

Figure 18:
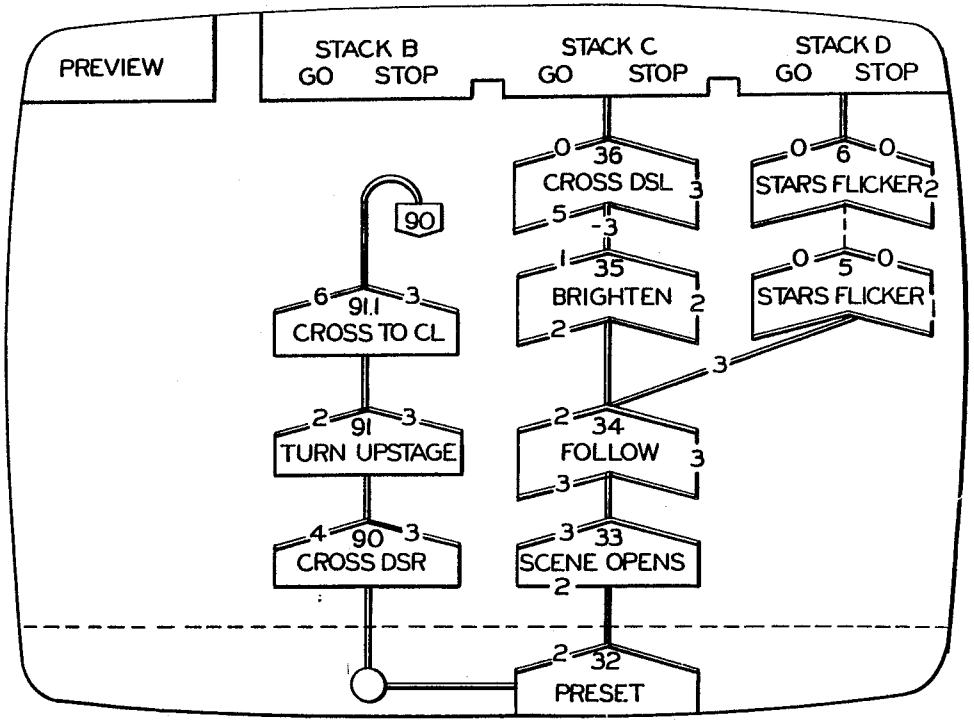
FIG. 18 is a graphic display of cue sequences as may be produced by the interactive visual display of the improved control system of FIGS. 11A and 11B.

FIG. 18 is a graphic presentation of such cue sequences and their related variables that is more readily understood.

In the illustrated embodiment, each cue is represented by a graphic symbol. Those cues forming a sequence (whether by virtue of ascending numeric order or a specific "go to" or "link" ), are disposed vertically along a common axis in a "stack". In the Figure, three stacks are pending.

The top edge of the cue symbol illustrated forms an arrow indicating the direction of the cue sequence, and the cue number is located under its point.

A field for an alphanumeric memo identifying the function, contents, or location of the cue in the production is also provided in the symbol.

The cue presently onstage is typically at the lower margin of the screen, here Cue 32, below the dashed line.

A cue that requires manual initiation is indicated, in this embodiment, by a symbol with a straight lower edge, as, for example, Cue 33 and the Cues 90–91.1 in Stack B.

A cue that will automatically trigger from a previous cue is indicated by a symbol with a chevron shape.

The illustrated cue symbol also provides for numeric values representing conventional in-times, out-times, waits, and durations. In the case of the cues in Stack C, the in-time value is located in the bottom edge and the out-time value in the top edge of the cue symbol. An alternate location for these values is illustrated in the case of Stack B and Stack D, the out-time being located to the right side of the top edge of the cue symbol.

Where the duration that the cue is onstage is specified, this value is illustrated as appearing in the right side of the cue symbol.

Where there is an offset between the initiation of the "fade-out" of the previous cue and the "fade-in" of the new one, that offset is indicated in the illustrated embodiment by a value on the vertical line linking the two cues.

FIG. 18 also illustrates how the disclosed operator interface uniquely clarifies complex relationships between multiple cue sequences. Cue 34 has been linked to both Cue 35 and Cue 5 such that executing the "fade-out" of Cue 34 will result in not only a 2-count "fade-out" of Cue 34 and a 2-count "fade-in" of Cue 35 but, after a 3-count delay, a 0-count "fade-in" of Cue 5, leading to the simultaneous automatic execution of the cues in both Stack C and Stack D. Similarly, the execution of Cue 32 has caused the system to load the cue sequence beginning with Cue 90 into Stack B, although, as can be seen by the shape of the symbol, Cue 90 will not proceed until initiated manually. Further, after executing Cue 91.1, the screen indicates that the system will loop Stack B back to Cue 90.

The function of the illustrated screen extends beyond depicting the relationship between cues. The interactive capability of the display permits the user to "scroll" forward and backward through the cue sequences by, for example, touching any blank area of the screen/display to "grab" it, and then stroking the display upwards or down. Fields can also be provided specifically for the purpose. The next cue in a stack can be initiated or a running cue halted by means of a corresponding field, here located along the top edge of the screen/display and/or by touching the cue symbol itself.

The illustrated embodiment is capable of multiple modes, determining the effect of touching or otherwise designating a cue symbol.

As indicated by the mode field in the top left corner, the illustrated screen is currently in the Preview mode.

This mode permits the user to display the contents of any given cue by touching its symbol. The visual display, or preferably another visual display, presents the parameter values for that cue for review and/or modification.

Modification of cue times, memo fields, and other data related to the cue itself can be performed at a Cue Preview screen such as illustrated in FIG. 16. Preferably they can also be modified from the Cue Sequence screen. While this could be performed with a mode change, preferably one side of the cue symbol is defined as being "Preview" and the other "Modify". Touching or otherwise designating the "Modify" side of the symbol will present the current values associated with that cue in the same or another display for modification, for example, as in the manner of the various prior screens. Given a pointing means with sufficient resolution, the operator can touch the displayed value he or she wishes to edit. Similarly, the user can establish links not only by numeric entry, but by simply "drawing" them on the display.

The screen illustrated in FIG. 18 employs only one of several possible approaches to the graphic display of cues, cue times, and cue relationships.

It will be understood that the time values of cue transitions, waits, and durations can themselves be depicted graphically, such as by employing the vertical axis of the screen as a proportional time line.

Consider, for example, the symbols in FIG. 18 associated with Cues 33 and 34. The "fade-out" of Cue 33 is a 3-count, the "fade-in" of Cue 34 is also a 3-count and there is no offset or "wait" between them. These values could be represented by employing for the top edge of the symbol for Cue 33, an upward-slanting line whose slope is proportioned to the "fade-out" duration, and a corresponding shape for the bottom edge of the cue symbol for Cue 34, such that the two edges nest. The slope of the interface between these symbols would be greater than that of the interface between Cue 32 and Cue 33, which involves a 2-count transition. The top edge of the symbol for Cue 5 and the bottom edge of the symbol for Cue 6 would both be straight as their time values are "0", but there would be a one-unit gap between the adjacent edges of the two symbols due to the 1-count "wait" between them. Unequal "in-times" and "out-times" would result in adjacent cue symbols with edges not parallel, the relationship between their respective times and "wait" value (if any) producing a partial overlap between symbols and/or a gap of varying size, which represents a uniquely useful visual metaphor for the effects of such transitions. Similarly, the height of the parallelsided portions of the cue symbol can correspond, in the case of cues with preset durations, to the programmed duration value. It will be recognized that the time scale to vertical display height unit correspondence can be non-linear so as not to consume excessive display height in the case of longer cues and transitions, and that break lines can be used for cues with durations above a certain value.

The values for transitions, waits, and durations can be modified not just by conventional numeric entry but by "grabbing" the cue symbols on the display with a cursor or pointing device add stretching them in the vertical axis.

In the case of systems based on storing "changes" rather than "presets", and particularly in the case of the disclosed control system, which is capable of storing individual durations and "wait" times for each parameter change for each cue/event, the top level cue sequence screen can be simplified.

Programming Waypoints

It will be understood that, in addition to programming point-to-point transitions per se, that the operator may wish to specify the route or trajectory that the beam will follow between points, in order to follow the motion of a performer or scenic element; to avoid illuminating a performer or object between the two endpoints; or simply for aesthetic effect.

Such a trajectory could be manually entered and stored in digitized form, however, at a considerable cost in memory. Preferably, however, the operator will specify waypoints that define the trajectory, the system generating the stream of azimuth and elevation values required to link the desired waypoints.

It will be understood that it is also desirable to specify the time between each of the waypoints as a method of allowing the operator to vary the rate at which the beam navigates the stored trajectory.

Programming Subroutines

In addition to programming beam movements in terms of desired positions, it will be desirable to provide a method of specifying beam motions per se, such as circles and ellipses, by the location of their centerpoints and the dimensions of their axes. This allows the operator to quickly and precisely specify apparently random motions of the beam. Such subroutines are preferably performed by the local control system or motion control hardware associated with each fixture with only a call of routine type, speed, centerpoint, and dimensions from the supervisory level of the system, minimizing the workload on its centralized portions.

Regular changes in beam color, size, or intensity can be treated in a similar manner, either by association with motion control routines or as separate routines of their own.

Programming Boundaries

It will further be understood that absolute location boundaries may be specified that limit the movement of beams. For example, during manual adjustment or a programmed movement, the beam from a fixture may strike a camera lens, stray beyond the stage area, or illuminate an unattractrive piece of scenery or stage equipment. The operator may enter the absolute locations of such "off-limits" areas into the system using a display mode similar to that of FIG. 15. When comparison of the absolute location of a fixture beam with this "stencil" indicates that it has reached such a boundary, the beam may be redirected or, more simply, shut off while it transits the "off-limits" area.

Programming Size/Color Symbols

Returning to FIG. 17, one method of entering the data required for display of the appropriate color and beam size symbols in the Fixture Adjustment mode is automatic; the response to "polling" on power up may, as previously described, provide fixture information including the type of beam size/shape and color varying means provided. While this response may be sufficient to identify a fixture as having continuously variable size adjustments versus an aperture wheel, or a six-color semaphore changer versus a trichromatic system, it will not be capable of identifying those apertures or those colors when they can be changed—unless an automatic capability for determining the current selections (as previously described) has been provided. Where such capability has not been provided, the operator must enter the necessary information. In the case of apertures or gobos, the relatively limited number of available alternatives suggests that symbols like 411–418 may be resident in the system under identifying codes corresponding to the ordering code identifying the gobo. In the case of color, the ordering code for the filter material in each changer position may be entered, but as only a relatively limited range of colors is necessary for actual display, the conversion between the ordering code and the displayed color performed at setup by a lookup table. Alternatively, the operator could specify the display color preferred either as an alphanumeric value or by selection from an onscreen palette. It will be understood that this information could also come from the offline use of a lighting drafting/paperwork system as previously described.

Programming Location Symbols

The programming of symbolic locations that correspond to a variable absolute location has been previously described. These symbolic locations can be represented on a display screen by the alphanumeric codes specified by the operator. They can, however, also be represented by a graphic symbol, just as the shape of a particular gobo is represented graphically (for example, as illustrated in FIG. 14). With a simple drafting or sketching program producing compatable entities, the user can compose a graphic symbol for each symbolic location having the best associative value. These entities will then appear at the absolute locations currently defined for their symbolic values in a screen display of absolute locations such as FIG. 15. However, there is no requirement that all display screens place such symbolic locations in current absolute relationships. To the contrary, the user may also design more abstract screens with little or no such literal correspondence to absolute location (equivalent to the well-known "magic sheet") by dragging symbols to the desired screen location. The disclosed interface can support such "magic sheet" displays with the simple expedient of providing additional fields in the symbolic location record for the screen location of each such symbol in each such abstract screen display.

It will be recognized that the display of the absolute or symbolic location onstage that a fixture beam intersects is not limited to fixtures with remote azimuth and elevation adjustment capability, but that the user can manually enter the location at which conventional fixtures with not such remote capability have been focused so that the effects of their intensity adjustments as well as the adjustment of any other variable beam parameters (such as color by a color changer) can be integrated into the various screen displays.

It will also be apparent that symbolic "magic sheets" can also be used in systems controlling only intensity to provide a far more natural interface than the entry of channel numbers traditionally employed. Unlike the system disclosed in U.S. Pat. No. 4,703,412, the "magic sheet" such as illustrated in FIG. 3 or FIG. 4 of that application can be readily produced on a CRT or other electronic display, and the operator employ either a "touch" interface or a pointing device such as a digitizing tablet or mouse, to designate the desired group of channels/outputs for adjustment. Such a display can use colors corresponding to those of the controlled fixtures; be automatically updated to reflect their current status; be readily changed and modified as desired; and can be stored with the cue data for subsequent reuse. Further, while the system disclosed in that patent permits the operator to use a hard copy "magic sheet" on a digitizing tablet to bypass channel numbers for entry, it still employs such numbers and the conventional matrix display of intensity values of FIG. 7 (as was first disclosed in U.S. Pat. No. 3,898,643). The operator must, therefore, continue to mentally convert channel numbers to functions in order to determine the current status of the system both during the process of writing cues and of subsequently reviewing them.

By contrast, the disclosed interface permits a graphic display of system status (by, for example, presenting the symbols for inactive channels in outline and those at level filled with the color of their beam) permitting the operator to instantly grasp system status. The percentage value of active channels can further be presented numerically within the symbol. Such an approach obviates the need for the operator to employ channel numbers at all and represents a far more efficient solution to the problem.

Physical Embodiment

A plan view of one physical embodiment of the improved control system is presented in FIG. 11B.

A console 150C mounts a flat panel display 170 and associated touch screen 172 previously described, along with a keypad 179K providing number and certain basic function keys for rapid entry of numeric values. Known linear touch encoders 178E and 178F are provided for rapidly incrementing values and for "scrolling" the field of view of display 170. Hardware pushbuttons with a crisp tactile feel 178B are provided along the lower edge of display 170 for functions (like the step advance of cues or chase sequences) that require such tactile feedback. At least one input device suitable for pointing in two or more axes, here three-button mouse 178M is provided. Two multi-sync color monitors 174 and 176 are provided. Input and output connectors are mounted on the rear surface 150B of the enclosure 150C. A "beard" enclosure 178P having linear faders for use as scene or matrix masters can be added at the lower edge of the console enclosure 150C when desired.

Internally, many hardware and software designs for the improved control system of the present invention can be employed and, as a consequence, FIG. 11A illustrates the functional organization of the system.

Four major functions are required.

One is the Data Management function 164.

The disclosed system constitutes a database management system including the following record types:

A Parameter Change Record (PCR) is provided for each parameter value change for each fixture. A PCR is a record of at least 64 bits including the cue number (15 bits); cue group (4 bits); fixture number (9 bits); parameter identifier (4 bits); parameter value (10 bits); change duration (12 bits); delay between cue and change initiation (10 bits). A single parameter value field suffices for most parameters including symbolic locations. Azimuth and elevation, absolute location, and unconverted three-value additive and subtractive color values require additional fields and such PCR records (recognized by their parameter identifier value) provide two additional 16 bit fields for a 96 bit length.

Each parameter change can optionally be assigned to any one of up to sixteen cue groups within a cue number. These subgroups within a cue can be used to simplify subsequent modifications to cues, cue times, and cue execution.

The default duration and delay time values are "global", that is, the time values assigned to the cue itself (or the group within the cue). All PCRs with specified durations and/or delays are, therefore, exceptions to the global cue times.

A Cue Record (CR) is provided for each cue or group in a cue referred to in a Parameter Change Record (PCR).

The Cue Record includes fields for the cue number and group; an alphanumeric memo field (0–32 characters); global duration; global delay; the "link from" or prior cue in the sequence (default value: the next lower cue number in use); the event that triggers the execution of the cue (manual input; SMPTE, MIDI, or motion control output; defined delay after the execution of the previous cue).

A Symbolic Value Master Record (SVMP) is provided for every symbolic location value referred to in a Parameter Change Record (PCR). It includes at least the internal code used to represent the symbolic value; the operator-defined alphanumeric identifier; a pointer to the file with the graphic symbol, if any, displayed for the symbolic value; the X, Y, and Z absolute values of the symbolic location; and the starting and ending cue numbers for which the record is valid. Thus, several different Symbolic Value Records can be used to reflect simple changes in the absolute location of a symbolic location during a performance (for example, with the movement of an actor or piece of scenery). As has been described, absolute values for symbolic locations can also be "patched" to external devices (such as the mouse 178M or motion control system 993) that update the current absolute location.

A Device Master Record (DMR) is provided for each fixture that is under the control of the system. The Device Master Record includes fields for the fixture/device number; its type (which also serves as to identify the graphic symbol used for its display); its X, Y, and Z locations in space; and the support to which it is attached (which, as has been described, can be used to modify location data).

A Device Supplemental Record (DSR) is provided for each variable parameter of each controlled fixture. The Device Supplemental Record includes fields for fixture number; parameter identifier (the same 4 bit value used in the PCR); a code for the mechanism employed; the allowed range of adjustment values; and the display attributes for representing each value. It is the Device Supplemental Record that is used to configure the operator interface. The mechanism code points to the graphics file with the symbols presented for adjusting or displaying parameter values on the display (for example, the fields 321–329 for the semaphore color changer of FIG. 13 versus the fields 421–431 for the three-color system of FIG. 14). The allowed range fields can be used to set boundaries as previously described, or, with the benefit of feedback from the device, to reflect a physical limitation imposed on the device's mechanical travel by, for example, an adjacent obstacle. The display attribute fields are used to specify, for example, the colors that will be displayed within the fields 321–327 of FIG. 13 or the aperture symbols 411–418 of FIG. 14. While the database system anticipates the ability to store individual such variables for each parameter mechanism, more commonly, the Device Supplemental Record will use default values for each defined mechanism or subgroup of devices employing that mechanism, permitting a single selection and display attributes file to serve for all such mechanisms or mechanism in that subgroup.

It will be apparent that the storage and manipulation of this database can be performed by many known hardware and software combinations A Data Store 166 such as a semiconductor memory and/or hard disc will be provided for mass storage of records. A means suitable for use as a data carrier such as a floppy disc drive or a memory card system will also be provided.

The second major function is the Routing/Buffering Interface 160.

This function includes the basic communications functions (corresponding to the lower levels of the ISO OSI model) associated with maintaining the serial interface across dashed line 150 between the centralized portion of the system and the various controlled devices and external sources of input.

While this function can be performed by the general system, it will be recognized that one or more intelligent interface subsystems can bear most of the basic communications workload, and do so in a manner (particularly given the use of data buffers) that considerably simplifies the design and improves the efficiency of the system as a whole. Further, the use of intelligent communications subsystems permits the support of different manufacturerspecific communications protocols by employing a separate such subsystem for each.

Further, certain communications tasks (such as the previously-described incorporation of serial intensity values from an external lighting control console 493) need not, in fact, require the participation of the system as a whole. To the contrary, by performing this routing entirely within the interface area, such as within one or between a pair of intelligent interface subsystems, the workload on the other portions of the system (such as that performing the Data Management function 164) can be further reduced. Such an arrangement does not, of course, prevent the passing of intensity values to and from other portions of the system.

During certain operations, the Routing/Buffering Interface 160 acts in concert with other functional areas, most frequently the Data Management function 164.

Dedicated intelligent communications controllers are available for many micro-computer bus systems, including the IBM "PC/AT" bus, most notably for the support of local area networks. Serial interfaces are well known in the lighting control art and additional prior disclosures include U.S. Pat. Nos. 3,845,351, 4,095,139, 4,392,187 and EPO App. No. 0 253 082 A2.

The third such major function is the Operator Interface 162.

The interactive operator interface disclosed employs known displays (such as the previously-identified flat panel and color CRT displays) and known display controllers such as those EGA, VGA, and PGA cards available for the "PC" bus.

As previously noted, several manufacturers of touch interface hardware (including MicroTouch Industries, Woburn, Mass.) offer software programs representing a readily customized screen graphics design and touch field definition interface to user applications programs. Those such programs based on commercially-available graphics description languages (such as the Halo TM package of Media Cybernetics, Inc., Silver Spring, Md.) offer the possibility of interchanging symbols, screens, and files with off-the-shelf drawing and CAD drafting programs based on the same graphics language system.

Associated with the Operator Interface function 162 are the various graphics files associated with screen and symbol generation.

A lighting memory system employing a very basic form of interactive display is disclosed in U.S. Pat. Nos. 3,898,642, which was reduced to practice as the Skirpan Auto-Cue TM.

The fourth such major function is an overall system controller responsible for general housekeeping and for regulating overall operation of and the exchange of data within the total system. This function can be performed by any known micro-processor system, employing either custom hardware as disclosed in any of the prior references; or an established micro-computer bus system such as known industrialized "PC/AT" bus systems based on the Intel 80286 and 80386 processor.

The operation of the disclosed embodiment will now be briefly described with reference to the various Figures.

Physical System Definition

At power-up, after initialization, the system controller, via the Operator Interface 162, asks the operator via one or more displays 170, 174, and/or 176 whether an existing show is to be loaded or a new show created.

If the operator selects "New Show", the system asks the operator whether the definition of the physical lighting system is to be loaded from an existing file.

If the operator responds "no", the system controller instructs the Routing/Buffering Interface 160 to begin polling the connected devices 486, 186, and 180 via their serial link. In the manner previously described, the system will poll each device address and, upon receiving a response at an address, will instruct the Data Manager 164 to enter a Device Master Record (DMR) for that address, and a Device Supplemental Record (DSR) for each parameter identified as controlled, along with all available information on the selections available for that parameter. Where information is not available over the serial link (because, for example, a fixture cannot return its gobo selection automatically), the field is left blank, and will remain so until entry is effected by another means. Following the completion of the polling process, the system database will include Device Master Records (DMRs) and Device Supplemental Records (DSRs) for each responding device.

A housekeeping utility associated with Data Manager 164 can scan the record sets and prompt the operator for variables not available.

The selection of a device with undefined display attribute fields for its color changer would result in a display such as FIG.13, whose color fields 321–327are numbered and presented in outline, but not colored. Upon selecting such a device, the operator can be offered the opportunity to enter color attribute values by, for example, selection from an onscreen palette.

Similarly, as previously described, such "polling" will not find devices incapable of response, for which the user can be prompted to enter the information required for an MDR and SDRs when he or she first seeks to adjust the device by numeric entry of its address.

The absolute location of a device can be entered manually, or, where the operator has used a CAD package to produce a "plot", the disc with that file can be inserted in the console disc drive and read to enter the absolute locations of the devices into their MDR records.

Similarly, scale drawings/databases with the views of the performance area/set itself can be loaded.

The function of a CAD package can be extended to include the specification of all relevant data about the devices, which can be expressed in the form of compatable MDR and SDR records.

If the operator responds "yes" at the "Load Physical System Definition from Disc?" prompt, the MSRs and SDRs are loaded directly from disc (whether generated by such a compatable CAD package or a prior show) an, in this case, (or that of loading an existing show from disc by choosing to do so at the first prompt), the purpose of the serial poll is to find any discrepancies between the database records and the responses from the actual devices, and to generate a report of such discrepancies for the operator.

Display Modes

With the MDRs and SDRs defining the physical lighting system entered, the process of entering cues can begin.

While the function of various displays and input devices are readily changed, frequently CRT 174 will be used to present Device Selection screens. Such screens can take the form of a two-dimensional plan view as illustrated in FIG. 12. It will be recognized that MSRs represent a three-dimensional, object-oriented database that may be used with a standard CAD package to develop a three-dimensional presentation of the physical lighting system. This permits the user to define a "point of view" in addition to plan view, such as one equal to the current console location, that provides a more useful presentation of the physical system. Further, as has been described, the user can also create more abstract representations of the lighting system.

Frequently, CRT 176 will be used for Device Adjustment screens such as illustrated in FIGS. 13, 14, and 15.

Frequently, the flat panel display will be used for one or more of the following functions:

As a virtual control panel with additional actuator surfaces and displays required by the current mode.

As a display of the contents of a record.

As an additional display for any of the illustrated screens.

As an interactive, graphic flowchart that presents the user with the options available at each step during an operation, and permits the user to make choices by touching or designating the appropriate symbol.

Operating Modes

During operation, the physical lighting system reflects the result of all previous cues. By updating a "Stage" file with each parameter value sent to the devices, the control system will have available a single file that reflects the current state of the physical system such that the control system can display it as well.

Clearly, discrepancies can arise between the current state of the physical system and its desired state as reflected in the "Stage" file. Once the message to initiate each cue has been sent to the devices, the system waits for a time equal to the greatest total of change duration plus initiation delay in that cue, and then sends a general "Cue Complete?" transmission to all devices. The control system associated with each device, in response to that message, compares the desired state of its parameters with their actual condition and returns an exception message only if there is a discrepancy between the two.

Each device can also, of course, be polled for the current state of its parameter values and, while in some cases such a poll may be of value, the relative demand on the serial link and the computational load on the centralized portion of the system are vastly greater.

CRT 174 will offer a two-dimensional plan, a threedimensional view, or an abstract presentation of the physical system, as selected by the user. The contents of the Cue Record for the last cue will be presented on display 170. The current status of the system (or any selected cue) can also be presented on CRT 170 by reference to the "Stage" file. For example, a white device symbol outline can be used for all devices that change at least one parameter value in the current cue (symbol outline color attribute equals white for all devices with one or more PCRs with the current cue number). These symbols can also be filled with the current beam color if the fixture beam is on (symbol fill color attribute value equal to defined color attribute of current parameter value for all devices with non-zero intensity). Device symbol outlines and/or fills can, in other modes, reflect device groups and subgroups within a cue.

CRT 176 can reflect the absolute locations of the beams using a display such as illustrated in FIG. 16.

The user selects one or more devices for adjustment by numeric entry of the device address or by touching or designating the device symbol on the display as previously described. Conversely, in the display of an existing cue, all devices currently illuminating a symbolic location can be selected by touching or designating the alpha code or symbol for that location.

Upon selection of a device or group of devices, the physical system display mode changes to highlight the selected devices by changing the source of the symbol outline color attribute value. By referring to mechanism values stored in the SDR records for the selected fixtures, the system composes on CRT 176, the appropriate Adjustment screen, for example, as illustrated in FIG.13–15. Interaction with the Adjustment screen will open Parameter Change Records for the appropriate devices with a code for "Temporary" in the Cue Number field.

The creation of "Temporary" PCRs permits modification of previously-recorded adjustments without losing them, and the simultaneous display of the recorded value and a temporary value as described in connection with FIG. 13.

The user may modify the current cue with the new adjustments (which substitutes the current cue number for the "Temporary" code in the Cue Number field and deletes any existing PCRs with the same Cue, Device, and Parameter Identifier values); abandon the new adjustments and restore the previous state of the same cue (deleting the records with a "Temporary" code in the Cue Number field); or assign a new cue number to the modified state of the lighting system (by substituting the new Cue number for the "Temporary" code in the Cue Number field).

A new cue number may be entered at the flat panel display 170, by incrementing the record in the display to a new Cue Number using a touch field provided and/or using the keyboard 179K, and by "filling in" the remaining fields in the Cue Record. At entry of the alphanumeric memo, a portion of the flat panel display 170 can be redrawn to provide the necessary QWERTY keyboard.

During the performance, one or more of the displays can be used for Cue Sequence displays.

It will be seen that the disclosed control system permits the entry of new cues, and the examination and revision of existing ones in a uniquely efficient manner.

Video Image Memory

It will also be understood that the complexity of variable parameter cues renders their display difficult and ultimately it will prove most desirable to capture, by means of an imaging device, a picture of the stage under the conditions of illumination produced by that cue and to store it under a similar code number. Thereafter, previewing that cue will produce not only a numeric and/or graphic display of recorded data, but a visual display as well. Suitable hardware and software such as the A.T.&T. "Targa" system are available.

Simulation

It will also be seen that the disclosed system maintains all of the data required for known 3D imaging software to create a rendering of the effect of any cue for display on display 174 or 176 either as a still frame or, given sufficient processor power (for example, with the insertion of a dedicated graphics engine card), as an animation that permits the user to preview the effect of a cue without requiring the physical lighting system to produce it.

Alternate Input Devices

It will be understood that while the disclosed operator interface preferably employs a subsystem locating the operator's finger over the graphic display, a subsystem sensing the location of a stylus or a light pen may also be employed.

It will be understood that subsystems (such as manufactured by Elographics or Zenith Data Systems) which sense not only X and Y finger or stylus location but pressure may be employed. This third output may be used to adjust height while entering absolute location (pressure increasing height above average stage level) or beam intensity, size, or saturation.

The resolution of available subsystems may be less than that of the controlled device where continuous adjustment is permitted. This requires strategies for providing the required range of adjustment.

One method is a scaling adjustment as disclosed in U.S. Pat. No.4,460,943 where gain is adjusted either by operator selection or software switching in response to rate. Such a system, particularly in the incremental mode, allows a range of adjustment far in excess of the resolution of the display area provided.

Another method is to provide a "tapping" function (a high resolution incrementing function) with a set of fields adjacent to or surrounding the "pointing" field, such as the extended lines of the pointing symbol 335 in FIG. 15. By touching the pointing symbol 335, the operator may drag the beam to an approximate location. Finer adjustments may be made by tapping the extended lines of the symbol causing it to increment in the direction of the line by the minimum value. Alternatively, large incrementing fields may be provided outside the adjustment area, fields which may be tapped or held to increment values.

Multiple Displays

Finally, while a single display/interface may be employed by a control system, the use of a plurality of such displays vastly increases the speed and fluidity of operation by presenting all of the necessary information simultaneously and minimizing the number of mode changes required.

Therefore, at least two displays would be provided, preferably one at a relatively steep vertical angle in front of the operator for the Device Selection display and a second between the first and the operator and more nearly horizontal for fixture adjustments, cue records, virtual controls, and flowcharts.

Other variations within the spirit of the invention will be apparent and should not be understood as limited except by the claims.

What is claimed is:

1. A color-mixing lighting fixture, said lighting fixture producing a beam suitable for entertainment lighting, and capable of the remote adjustment of the apparent color of said beam, said lighting fixture comprising:

(a) a light source and associated light collecting means;

(b) means for forming a beam suitable for illuminating a distant subject, said beam having an elongated optical centerline, said means for forming a beam cooperating with said light collecting means and providing at least a first plane substantially oblique to said centerline at which light energy passing through substantially any point in said first plane is substantially equally distributed across a second plane that is substantially oblique to said centerline where said beam illuminates said distant subject;

(c) at least one filter array disposed substantially coplanar with said first plane, said filter array comprising at least thee filter segments mechanically coupled in a common array, each of said filter segments having a bandpass different than the others of said filter segments and generally spaced about an effective center;

(d) means for carrying said filter array and for displacing it relative to said centerline to any selected one of a substantially continuous range of possible positions between a first position at which substantially all of the light energy in said beam passes through said filter segments and a second position at which substantially none of the light energy in said beam passes through any of said filter segments;

(e) means for rotating said filter array about said effective center to any selected one of a substantially continuous range of possible orientations such that the relative proportion of said energy passing through each filter segment in said filter array may be selected; and, (f) means, operable from a remote location and cooperating with said means for displacing and with said means for rotating, for conforming said filter array to said selected position and said selected orientation, such that the apparent color of said beam may be varied.

2. Apparatus according to claim 1, wherein said filter segments comprise red, green, and blue filter segments.

3. Apparatus according to any one of claim 1 or 2, wherein at least four of said filter segments are provided in said filter array.

* * * * *